US011048195B2

(12) United States Patent
Kajita et al.

(10) Patent No.: US 11,048,195 B2
(45) Date of Patent: Jun. 29, 2021

(54) FUSER INCLUDING ROTATABLE MEMBER AND ENDLESS BELT

(71) Applicant: Brother Kogyo Kabushiki Kaisha, Nagoya (JP)

(72) Inventors: Masahito Kajita, Nagoya (JP); Shuhei Fukue, Nagoya (JP); Kenji Takeuchi, Nagoya (JP); Mingguang Zhang, Nagoya (JP); Tomonori Watanabe, Ichinomiya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 16/878,738

(22) Filed: May 20, 2020

(65) Prior Publication Data

US 2020/0285183 A1 Sep. 10, 2020

Related U.S. Application Data

(63) Continuation of application No. 16/255,182, filed on Jan. 23, 2019, now Pat. No. 10,684,581.

(30) Foreign Application Priority Data

Jan. 24, 2018 (JP) ..... JP2018-009303
Sep. 28, 2018 (JP) ..... JP2018-184418

(51) Int. Cl.
*G03G 15/20* (2006.01)

(52) U.S. Cl.
CPC . *G03G 15/2053* (2013.01); *G03G 2215/2041* (2013.01)

(58) Field of Classification Search
CPC ..... G03G 2215/2041
See application file for complete search history.

(56) References Cited

U.S. PATENT DOCUMENTS 6,983,119 B2 * 1/2006 Nakayama ..... G03G 15/2064 219/216
7,627,278 B2 * 12/2009 Nakagawa ..... G03G 15/206 399/329
7,801,474 B2 9/2010 Nishinoue
7,953,349 B2 5/2011 Fukai
7,986,909 B2 7/2011 Nanba
8,080,359 B2 * 12/2011 Matsubara ..... G03G 15/206 430/124.33
8,280,291 B2 10/2012 Yamamoto et al.
8,295,751 B2 10/2012 Souda et al.
(Continued)

FOREIGN PATENT DOCUMENTS

JP 2002-148972 A 5/2002
JP 2003-5553 A 1/2003
(Continued)

*Primary Examiner* — Clayton E. LaBalle
*Assistant Examiner* — Leon W Rhodes, Jr.
(74) *Attorney, Agent, or Firm* — Banner & Witcoff, Ltd.

(57) ABSTRACT

A fuser is described including a heater, a belt, a rotating member, and a pad. A nip portion is formed between the belt and the rotating member as the pad presses the belt toward the rotating member. The pad is biased toward a restricting member. The biasing may be performed by one or more springs. The spring may be a compression spring, a tension spring, and/or a plate spring among other types of springs.

18 Claims, 22 Drawing Sheets

(56) References Cited

U.S. PATENT DOCUMENTS

| | | | | |
|---|---|---|---|---|
| 8,369,730 | B2 * | 2/2013 | Fujimoto | G03G 15/2039 399/67 |
| 2009/0052957 | A1 | 2/2009 | Nishinoue | |
| 2010/0247186 | A1 | 9/2010 | Tanaka et al. | |
| 2010/0284715 | A1 | 11/2010 | Yagi et al. | |
| 2010/0296849 | A1 | 11/2010 | Yamamoto et al. | |
| 2012/0093546 | A1 | 4/2012 | Ohara et al. | |
| 2016/0327900 | A1 | 11/2016 | Tanaka et al. | |

FOREIGN PATENT DOCUMENTS

| | | | |
|---|---|---|---|
| JP | 2009-047913 | A | 3/2009 |
| JP | 2010-231008 | A | 10/2010 |
| JP | 2010-262137 | A | 11/2010 |
| JP | 2010-271623 | A | 12/2010 |

* cited by examiner

FUSER INCLUDING ROTATABLE MEMBER AND ENDLESS BELT

CROSS-REFERENCE TO RELATED APPLICATION

This application is a continuation of prior U.S. application Ser. No. 16/255,182, filed Jan. 23, 2019, which claims priority from Japanese Patent Application No. 2018-009303 filed on Jan. 24, 2018 and Japanese Patent Application No. 2018-184418 filed on Sep. 28, 2018, the content of which are incorporated herein by reference in their entirety.

FIELD OF DISCLOSURE

The disclosure relates to a fuser that fuses a toner image onto a recording medium.

BACKGROUND

A known fuser, for example, as disclosed in JP2010-231008A, includes a heat roller, a pad member that nips an endless belt in cooperation with the heat roller between the pad member and the heat roller and serves to form a nip portion between the heat roller and the endless belt, and a holding portion that holds the pad member. The pad member includes a pressurizing pad that contacts the endless belt. The pressurizing pad is attached to a supporting plate. The pressurizing pad attached to the supporting plate is mounted in a recess in the holding portion, thereby holding the pad member in position relative to a moving direction of the endless belt at the nip portion.

SUMMARY

The following summary presents a simplified summary of certain features. The summary is not an extensive overview and is not intended to identify key or critical elements.

According to one or more aspects of the disclosure, a fuser is described including a heater, a belt, a rotating member, and a pad. A nip portion is formed between the belt and the rotating member as the pad presses the belt toward the rotating member. The pad is biased toward a restricting member. The biasing may be performed by one or more springs. The pad may be adhered to a plate that receives a biasing force from the spring. The spring may be a compression spring, a tension spring, and/or a plate spring among other types of springs.

These and other features and advantages are described in greater detail below.

DETAILED DESCRIPTION

Figure 1:
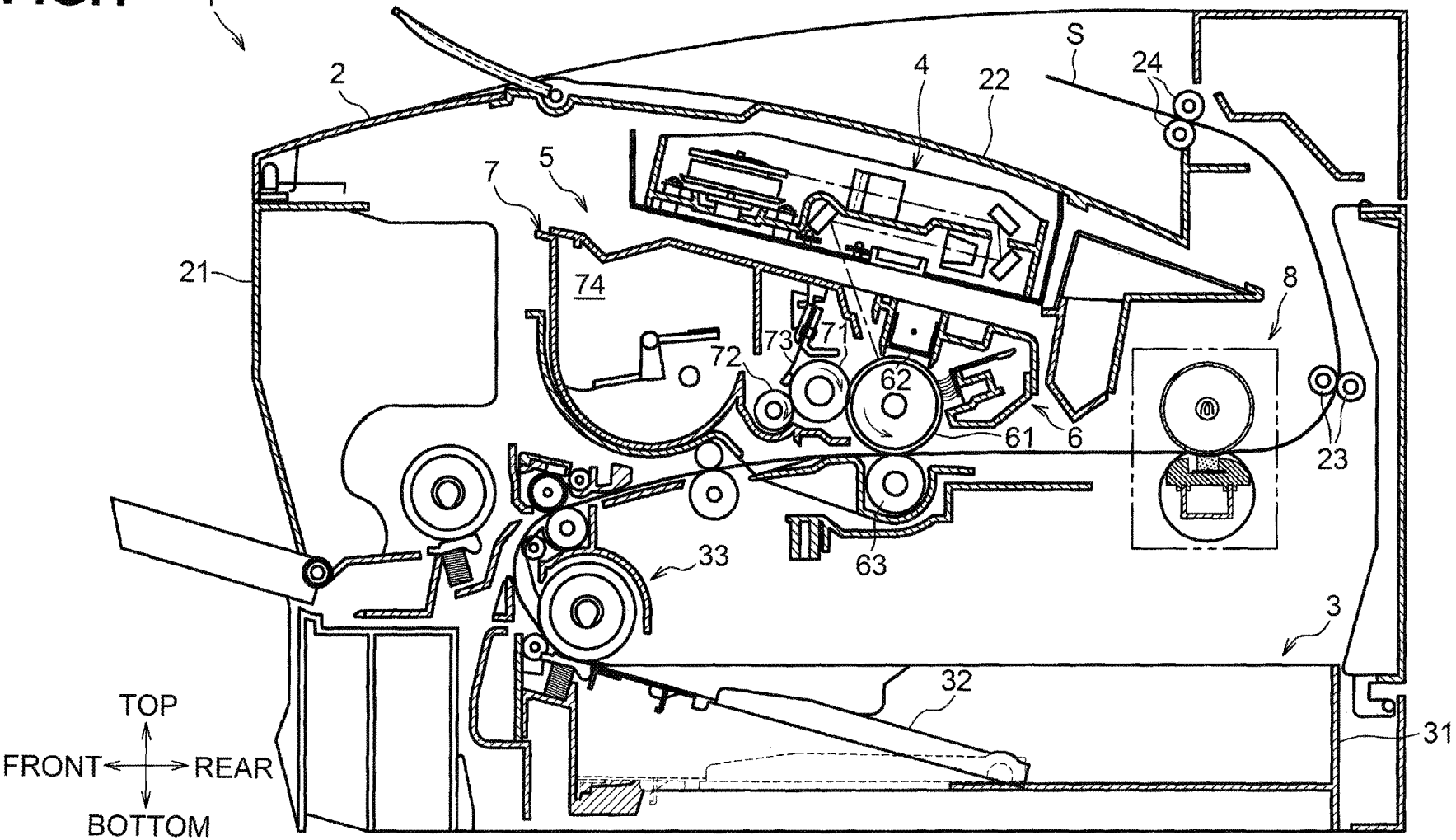
FIG. 1 is a cross-sectional view of a laser printer including a fuser in an illustrative embodiment according to one or more aspects of the disclosure.

An illustrative embodiment and modifications according to one or more aspects of the disclosure will be described with reference to the accompanying drawings. In the following description, directional terminology such as "top/upper," "bottom/lower," "front," "rear," "left," "right" etc., as labelled in the drawings, may be used. With respect to the page of FIG. 1, the left side may be defined as the front; the right side may be defined as the rear; the facing or near side may be defined as the right; the opposite side or far side may be defined as the left; the upper side may be defined as the top, and the lower side may be defined as the bottom. Because the disclosed components can be positioned in a number of different orientations, the directional terminology is used for purposes of illustration and is in no way limiting.

As depicted in FIG. 1, a laser printer 1 includes a casing 2, a sheet feeder 3, an exposure device 4, a process cartridge 5, a fuser 8, conveying rollers 23 and 24, and a discharge tray 22.

The casing 2 has an opening defined therein. The casing 2 includes a front cover 21 configured to move between an open position providing access to an interior space of the casing 2 through the opening, and a closed position (as depicted in FIG. 1) preventing access to the interior space.

The sheet feeder 3 is disposed in the casing 2 at its lower portion. The sheet feeder 3 includes a feed tray 31, a lifter plate 32, and a feed mechanism 33. The feed tray 31 is configured to hold a stack of one or more sheets S. The lifter plate 32 is configured to lift a front end portion of the sheet stack. The feed mechanism 33 is configured to feed each of the one or more sheets S to the process cartridge 5.

The exposure device 4 is disposed in the casing 2 at its upper portion. The exposure device 4 includes a light source (not depicted), and components, such as a polygon mirror, lenses, and reflecting mirrors, that are illustrated without reference numerals.

The exposure device 4 is configured to emit a laser beam from the light source based on image data to a surface of a photosensitive drum 61 (described below) of the process cartridge 5. The laser beam scans across the surface of the photosensitive drum 61 at high speed. The surface of the photosensitive drum 61 is thus exposed to light.

The process cartridge 5 is configured to be inserted into and removed from the casing 2 through the opening when the front cover 21 is in the open position. The process cartridge 5 is disposed below the exposure device 4 in the casing 2. The process cartridge 5 includes a drum unit 6 and a developing unit 7. The drum unit 6 includes the photosensitive drum 61, a charger 62, and a transfer roller 63. The developing unit 7 is configured to be attached to and separated from the drum unit 6. The developing unit 7 includes a developer roller 71, a supply roller 72, a blade 73, and a reservoir 74 configured to hold or store toner.

In the process cartridge 5, the surface of the photosensitive drum 61 is uniformly charged by the charger 62. The surface of the photosensitive drum 61 is then exposed to the laser beam from the exposure device 4 to form an electrostatic latent image based on image data on the photosensitive drum 61. The toner in the reservoir 74 is supplied to the developer roller 71 via the supply roller 72. The toner entered between the developer roller 71 and the blade 73 is carried on the developer roller 71 as a thin layer whose thickness is constant. The toner on the developer roller 71 is supplied to the electrostatic latent image on the photosensitive drum 61, thereby developing the electrostatic latent image into a visible toner image. The toner image is thus formed on the photosensitive drum 61. The toner image on the photosensitive drum 61 is then transferred onto a sheet S fed between photosensitive drum 61 and the transfer roller 63.

The fuser 8 is disposed to the rear of the process cartridge 5. The sheet S having the toner image transferred thereon is conveyed to the fuser 8 where the toner image is fused or fixed on the sheet S. The sheet S is then discharged by the conveying rollers 23 and 24 onto the discharge tray 22.

Figure 2:
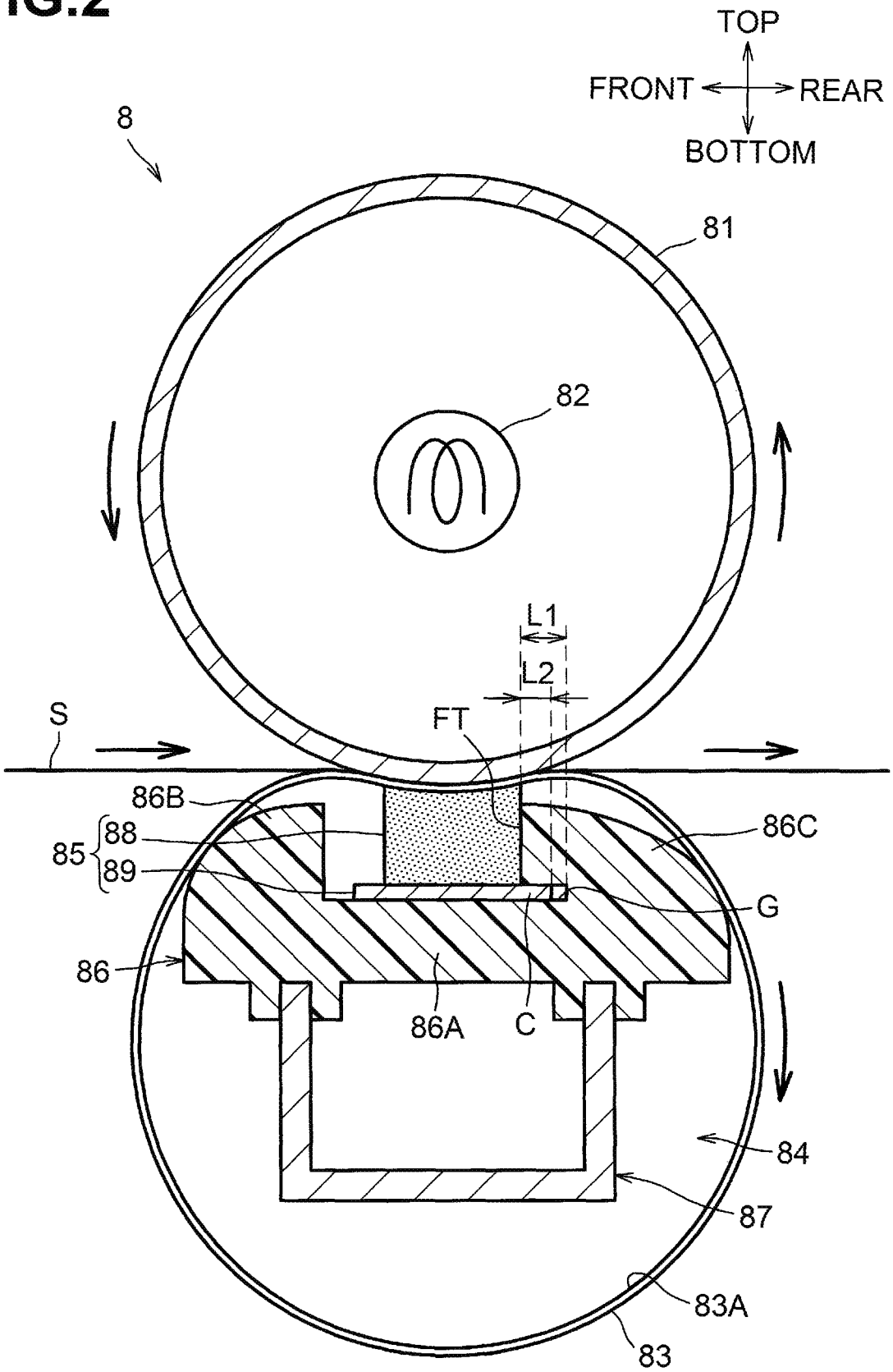
FIG. 2 is a cross-sectional view of the fuser.
Figure 7:
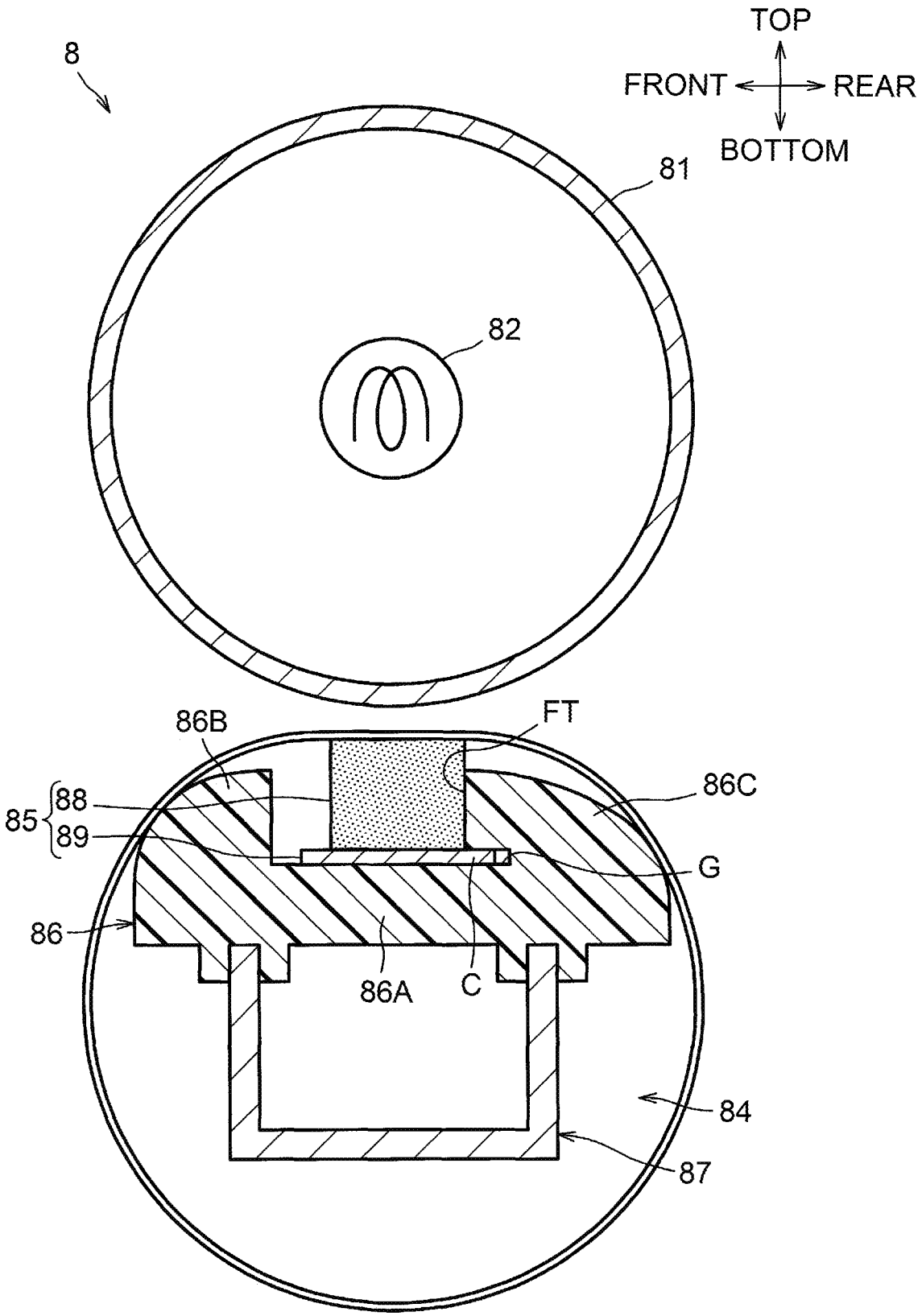
FIG. 7 is a cross-sectional view of the fuser in a nip released state.

As depicted in FIG. 2, the fuser 8 includes a rotatable member, e.g., a heat roller 81, a heater 82, an endless belt 83, and a pressure unit 84. One of the heat roller 81 and the pressure unit 84 is biased toward the other, thereby forming a nip portion NP between the heat roller 81 and the endless belt 83. The toner image is fused onto the sheet S when the sheet S passes through the nip portion NP. A state in which the nip portion NP is formed as depicted in FIG. 2 may be referred to as a "nipped state" while a state in which the nip portion NP is not formed as depicted in FIG. 7 may be referred to as a "nip released state".

The fuser 8 may be described in conjunction with a width direction of the endless belt 83, a moving direction of the endless belt 83 at the nip portion NP, and an opposing direction in which the heat roller 81 is opposed to the pressure unit 84 (e.g., a nip forming member 85 to be described below). The width direction of the endless belt 83 may correspond to a right-left direction. The moving direction of the endless belt 83 at the nip portion NP, which may be simply referred to as the "belt moving direction" hereinafter, may correspond to a front-to-rear direction. The opposing direction may correspond to the top-bottom direction.

The heat roller 81 has a cylindrical body. The heat roller 81 includes a tubular member and a release layer formed over an outer peripheral surface of the tubular member. The tubular member may include metal, e.g., aluminum. The release layer may include fluoro-resin. The heat roller 81 is configured to receive a drive force from a motor (not depicted) and rotate counterclockwise in FIG. 2. The heat roller 81 is in contact with an outer peripheral surface of the endless belt 83.

The heater 82 is configured to heat the heat roller 81 and disposed within the heat roller 81 or in an interior space of the heat roller 81. The heater 82 may be, for example, a halogen lamp, that may emit light upon energization to heat the heat roller 81 through radiant heat.

The endless belt 83 is a flexible tubular-shaped member. The endless belt 83 may include a base layer and a release layer formed over an outer peripheral surface of the base layer. The base layer may include, for example, metal such as stainless steel, or resin such as polyimide resin. The release layer may include fluoro-resin. The rotation of the heat roller 81 may cause the endless belt 83 to rotate or circularly move in a clockwise direction in FIG. 2.

The endless belt 83 has an inner peripheral surface 83A to which lubricant such as grease, is applied. The lubricant helps to enhance slidability between the inner peripheral surface 83A and the pressure unit 84, so that the endless belt 83 may move smoothly.

The pressure unit 84 includes the nip forming member 85, a holder 86 that supports the nip forming member 85, and a stay 87 that supports the holder 86. When the nip forming member 85 is supported by the holder 86, a portion of the nip forming member 85 (e.g., a pad 88) protrudes upward toward the heat roller 81 relative to a surface of the holder 86 closer to the heat roller 81. The surface of the holder 86 closer to the heat roller 81 corresponds to an upper surface the holder 86 in the illustrative embodiment.

The nip forming member 85 is configured to nip the endless belt 83 in cooperation with the heat roller 81 such that the nip portion NP is formed between the heat roller 81 and the endless belt 83. The nip forming member 85 is located within a loop or an internal space of the endless belt 83. The pressure unit 84 serves to form the nip portion NP where heat and pressure are applied to the sheet S to fuse the toner image on the sheet S. In the illustrative embodiment, the nip portion NP is a portion where the outer peripheral surface of the endless belt 83 contacts the heat roller 81. A portion of the nip portion NP may not receive pressures from the pad 88.

The nip forming member 85 includes the pad 88 and a plate member 89. The pad 88 is configured to nip the endless belt 83 in cooperation with the heat roller 81 between the pad 88 and the heat roller 81, and presses the endless belt 83 against the heat roller 81. The pad 88 is fixed or attached to the plate member 89.

Figure 3:
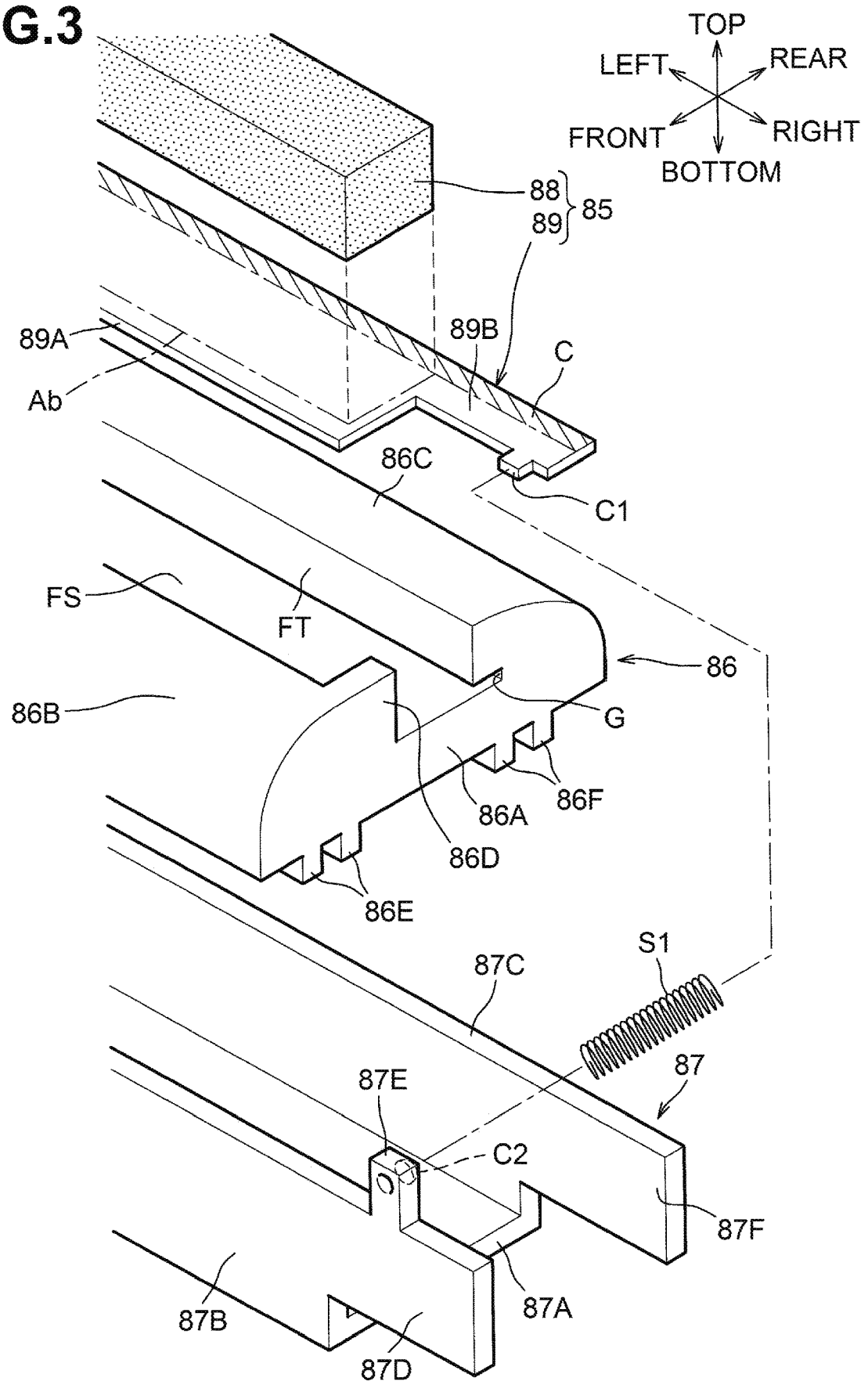
FIG. 3 is an exploded perspective view of a pressure unit of the fuser.

As depicted in FIG. 3, the pad 88 has a rectangular parallelepiped shape and is elongated in the right-left direction. The pad 88 includes elastic material, such as rubber, and is elastically deformable. Each of the pad 88, the plate member 89, the holder 86, and the stay 87 is generally symmetric with respect to a respective center thereof in the right-left direction. In other words, a right portion and a left portion of the fuser 8 including the pad 88, the plate member 89, the holder 86, and the stay 87 are similar to each other, so that the fuser 8 will be described in detail below, in conjunction with the right portion of the fuser 8, and detailed description with respect to the left portion will be omitted herein.

Referring to FIG. 3, the plate member 89 is a metal plate member having rigidity higher than rigidity of the pad 88. The plate member 89 includes a base portion 89A to which the pad 88 is attached, an extended portion 89B that extends rightward from a right end of the base portion 89A, and a first boss C1 extending frontward from a front end of the extended portion 89B, e.g., from an upstream end of the extended portion 89B in the belt moving direction.

The base portion 89A includes an attachment region Ab to which the pad 88 is attached. The base portion 89A has a width (e.g., distance in the front-rear direction) greater than a width of the pad 88, so that a space is provided between the pad 88 and a respective one of the front end and the rear end of the base portion 89A. The space between the pad 88 and the rear end (the downstream end) of the base portion 89A serves as a projecting portion C (indicated by hatching with parallel diagonal lines) that projects rearward relative to the pad 88 that has been attached to the base portion 89A.

The base portion 89A has a length (e.g., distance in the right-left direction) greater than the length of the pad 88, so that a space is provided between the attachment region Ab and a respective right and left end of the base portion 89A (the left end not depicted).

Figure 4:
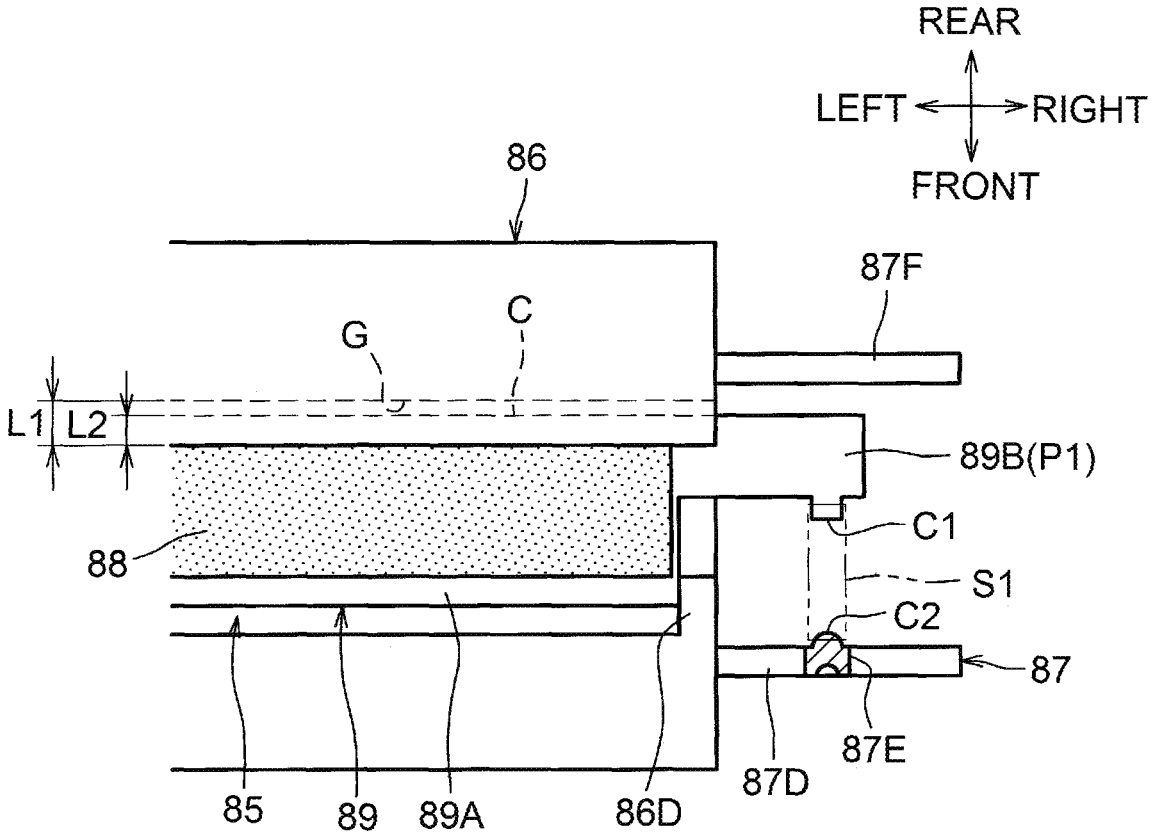
FIG. 4 is a top plan view of the pressure unit.

The extended portion 89B has a width (e.g., a distance in the front-rear direction) less than the width of the base portion 89A. The extended portion 89B is located at a rear end portion of the base portion 89A. As depicted in FIG. 4, the extended portion 89B of the plate member 89, when mounted to the holder 86, has a first portion P1 protruding rightward relative to the holder 86. The first portion P1 includes the first boss C1.

The first boss C1 is sized to engage in an internal space of a biasing member (e.g., a helical compression spring S1 to be described below) in its diametrical direction. The first boss C1 is spaced from the right end of the extended portion 89B. When the first boss C1 is engaged in the helical compression spring S1, the helical compression spring S1 may contact particular portions of a front end surface of the extended portion 89B. The particular portions are located to the right and left of the first boss C1.

The holder 86 may include resin or metal. The holder 86 includes a base portion 86A, an upstream wall 86B, a restricting member, e.g., a downstream wall 86C, a restriction wall 86D, two first engaging walls 86E, and two second engaging walls 86F. The base portion 86A is a plate-like portion and has a support surface FS extending in a direction orthogonal to the opposing direction or the top-bottom direction. The base portion 86A is elongated in the right-left direction. The support surface FS supports the plate member 89 to allow the plate member 89 to slidably move in the belt moving direction or the front-rear direction.

As depicted in FIG. 2, the upstream wall 86B protrudes upward toward the heat roller 81 from a front end portion of the base portion 86A. The upstream wall 86B has a curved surface that guides the inner peripheral surface 83A of the endless belt 83.

The downstream wall 86C protrudes upward toward the heat roller 81 from a rear end portion of the base portion 86A. The downstream wall 86C also has a curved surface that guides the inner peripheral surface 83A of the endless belt 83. When the nip forming member 85 has been mounted to the holder 86, the downstream wall 86C is disposed downstream of the pad 88 in the belt moving direction.

Referring back to FIG. 3, the downstream wall 86C includes a contact surface FT and a recess portion G. The contact surface FT is disposed at a front surface of the downstream wall 86C facing frontward and contacts the pad 88. The contact surface FT contacts the pad 88 in the belt moving direction, and is orthogonal to the belt moving direction. The contact surface FT faces upstream in the belt moving direction. The recess portion G is recessed into the contact surface FT toward the rear.

The distance from the contact surface FT to the upstream wall 86B in the front-rear direction is greater than the width (e.g., distance in the front-rear direction) of the base portion 89A of the plate member 89. This configuration may allow the base portion 89A to be readily placed onto the support surface FS through a space between the upstream wall 86B and the downstream wall 86C.

The recess portion G is grooved to allow the projecting portion C of the plate member 89 to engage therein. The recess portion G extends through the downstream wall 86C in the right-left direction. As depicted in FIGS. 2 and 4, a distance L1 of the recess portion G in the front-rear direction is greater than a distance L2 of the projecting portion C in the front-rear direction. In other words, the recess portion G has a depth (e.g., a distance in the front-rear direction) that is greater than a projecting amount of the projecting portion C relative to the pad 88 in the front-rear direction.

The recess portion G has an upper surface and a lower surface located farther from the heat roller 81 than the upper surface. The lower surface is flush with the support surface FS of the base portion 86A. The lower surface of the recess portion G may be located farther from the heat roller 81 than the support surface FS in the top-bottom direction.

The restriction wall 86D restricts the movement of the base portion 89A of the plate member 89 in the right-left direction by contacting an end (e.g., the right end) of the base portion 89A. The restriction wall 86D is disposed at a respective right and left end portion of the support surface FS of the base portion 86A (left restriction wall 86D not depicted), so that the base portion 89A may be located between the right and left restriction walls 86D. The restriction wall 86D extends from the support surface FS upward toward the heat roller 81 and is spaced from the downstream wall 86C in the front-rear direction.

The distance in the front-rear direction from the rear end of the restriction wall 86D to the contact surface FT is greater than the width (e.g., distance in the front-rear direction) of the extended portion 89B of the plate member 89. This configuration may allow the extended portion 89B to be readily placed onto the support surface FS through a space between the restriction wall 86D and the downstream wall 86C. In the illustrative embodiment, the restriction wall 86D is integral with the upstream wall 86B and the height of the restriction wall 86D (e.g., distance in the top-bottom direction from the support surface FS) is equal to the height of the upstream wall 86B (e.g., distance in the top-bottom direction from the support surface FS). In another embodiment, the restriction wall 86D may not necessarily be integral with the upstream wall 86B but may be separated from the upstream wall 86B. In yet another embodiment, the height of the restriction wall 86D may be less than the height of the upstream wall 86B.

The first engaging walls 86E engage with an upper end portion of an upstream wall 87B (described below) of the stay 87. The first engaging walls 86E sandwich the upstream wall 87B in the front-rear direction. Each of the first engaging walls 86E extends downward from the base portion 86A toward the stay 87.

The second engaging walls 86F engage with an upper end portion of a downstream wall 87C (described below) of the stay 87. The second engaging walls 86F sandwich the downstream wall 87C in the front-rear direction. Each of the second engaging walls 86F extends downward from the base portion 86A toward the stay 87.

The stay 87 may include resin or metal. The stay 87 has a U-shaped cross section, and includes a base wall 87A, the upstream wall 87B, and the downstream wall 87C. The base wall 87A has a plate shape and includes a surface orthogonal to the top-bottom direction. The base wall 87A is elongated in the right-left direction.

The upstream wall 87B extends upward toward the holder 86 from a front end portion of the base wall 87A. The downstream wall 87C extends upward toward the holder 86 from a rear end portion of the base wall 87A. The stay 87 includes an upstream extended portion 87D extending rightward from a right end of the upstream wall 87B. The upstream extended portion 87D has a height in the top-bottom direction less than a height of the upstream wall 87B in the top-bottom direction. The upstream extended portion 87D is located on an upper portion of the upstream wall 87B. Similarly, the downstream wall 87C includes a downstream extended portion 87F extending rightward from a right end of the downstream wall 87C. The downstream extended portion 87F has the same size as the upstream extended portion 87D and is located at the same position or level as the upstream extended portion 87D in the top-bottom direction.

Figure 5:
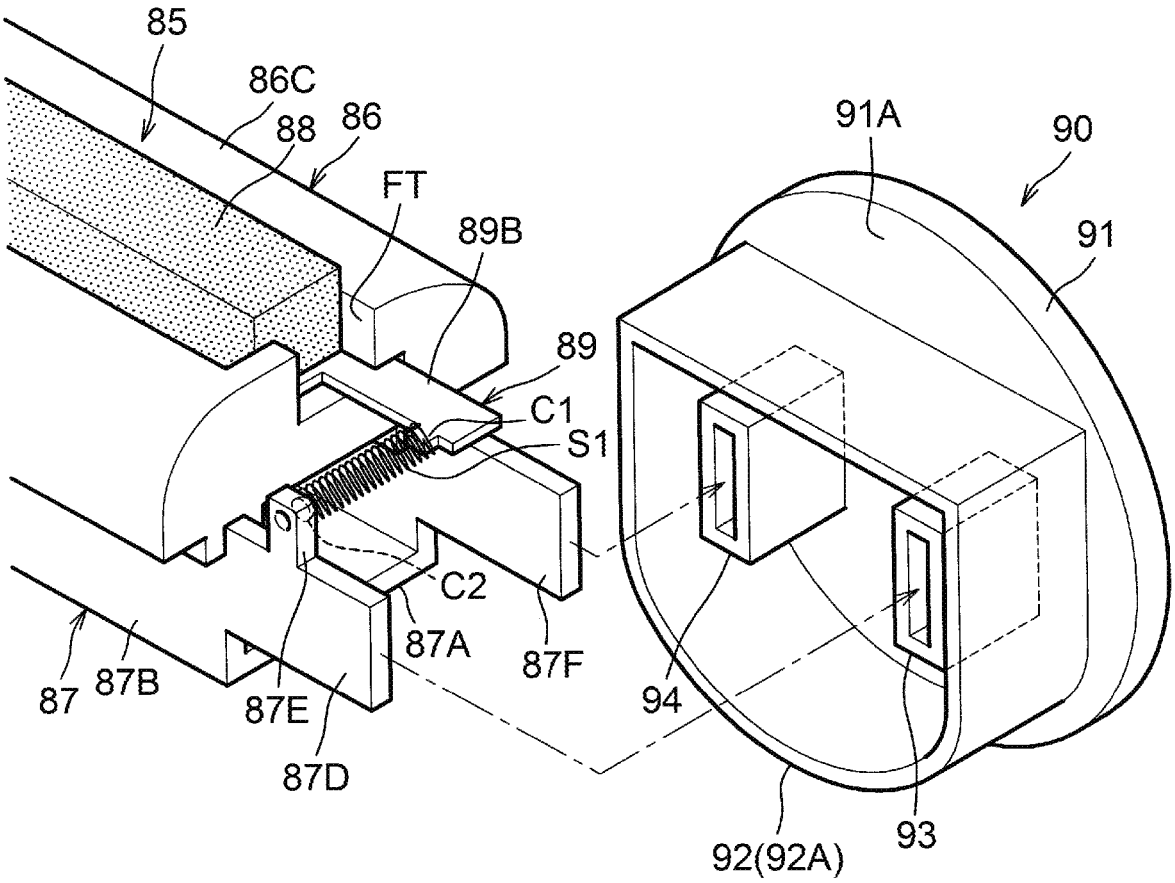
FIG. 5 is a perspective view of the pressure unit and a side guide of the fuser.

The upstream extended portion 87D has a protruding portion 87E protruding upward toward the holder 86 from an upper end of the upstream extended portion 87D. The upstream extended portion 87D and the protruding portion 87E serve as a second portion. As depicted in FIGS. 4 and 5, when the stay 87 has been attached to the holder 86, the second portion, e.g., the upstream extended portion 87D and the protruding portion 87E, is located to the right of the holder 86.

The protruding portion 87E includes a second boss C2 protruding rearward from a rear surface of the protruding portion 87E. The second boss C2 is sized to engage in an internal space of the helical compression spring S1 in its diametrical direction. When the nip forming member 85 and the stay 87 has been attached to the holder 86, the second boss C2 is opposite to the first boss C1 of the plate member 89 in the front-rear direction, so that an axis of the helical compression spring S1 extends along the front-rear direction.

The helical compression spring S1 biases the nip forming member 85 in the front-rear direction toward the contact surface FT of the holder 86. The helical compression spring S1 is disposed to the right of the holder 86. The helical compression spring S1 has one end contacting the extended portion 89B of the plate member 89 and the other end contacting the protruding portion 87E of the stay 87. The helical compression spring S1 is disposed at a right end portion of the plate member 89. The helical compression spring S1 is compressed between the plate member 89 and the stay 87 to bias the plate member 89 toward the rear.

Figure 6:
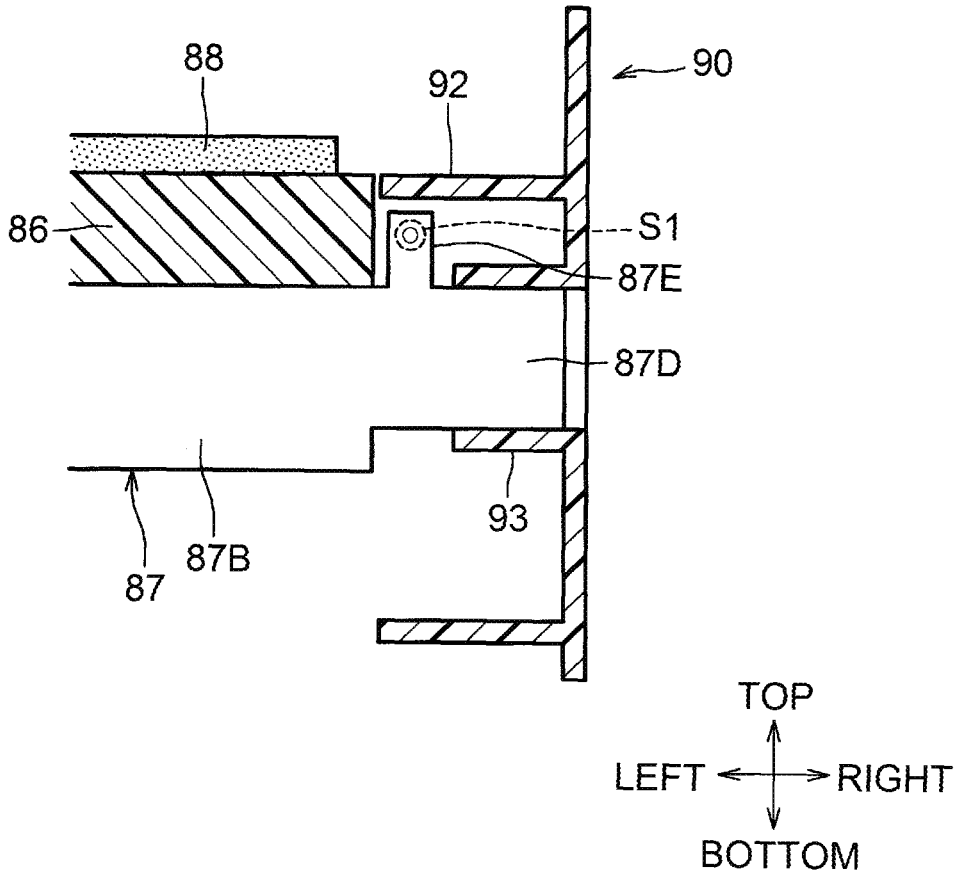
FIG. 6 is a cross-sectional view of the pressure unit and the side guide.

The fuser 8 further includes left and right side guides 90 (the left side guide 90 not depicted in FIG. 5) that guide the inner peripheral surface 83A of the endless belt 83. Since the left and right side guides 90 have similar configuration, the right side guide 90 is described in detail below. The side guide 90 is disposed at a right end portion of the stay 87. The side guide 90 includes a disk-shaped base portion 91 having a restriction surface 91A, a tubular-shaped belt guide portion 92 extending from the restriction surface 91A toward the left (as depicted in FIG. 6), and two stay support portions 93 and 94 that respectively support the extended portions 87D and 87F of the stay 87.

The restriction surface 91A of the base portion 91 restricts the movement of the endless belt 83 in the right-left direction by contacting the end (e.g., the right or left end) of the endless belt 83. The belt guide portion 92 includes a curved guide surface 92A that guides the inner peripheral surface 83A of the endless belt 83. Each of the stay support portions 93 and 94 has a rectangular tube shape and is located within an internal space defined by the belt guide portion 92. Each of the stay support portions 93 and 94 protrudes leftward from the base portion 91.

Each of the stay support portions 93 and 94 protrudes from the base portion 91 by a first amount. The belt guide portion 92 protrudes from the base portion 91 by a second amount. The first amount is less than the second amount. The first amount and the second amount are set or determined such that, when the extended portions 87D and 87F of the stay 87 are respectively engaged in the stay support portions 93 and 94, the belt guide portion 92 surrounds the helical compression spring S1 (refer to FIG. 6). In other words, as depicted in FIG. 6, when the side guide 90 has been attached to the stay 87, the helical compression spring S1 is located within the internal space defined by the belt guide portion 92 and overlaps with the side guide 90 in the right-left direction.

Technical advantages of the fuser 8 according to the illustrative embodiment will now be described. In the nipped state as depicted in FIG. 2, the helical compression spring S1 biases the nip forming member 85 toward the downstream wall 86C, so that the nip forming member 85 may contact or abut against the contact surface FT. This configuration may restrict the rearward movement of the nip forming member 85. In the nip released state as depicted in FIG. 7, the helical compression spring S1 also biases the nip forming member 85 toward the downstream wall 86C, similar to the nipped state, so that the nip forming member 85 may contact or abut against the contact surface FT. The rearward movement of the nip forming member 85 may thus be restricted. If the endless belt 83 is repeatedly nipped or released, the nip forming member 85 may be held in position relative to the holder 86. This may stabilize the position of the nip portion NP. The pad 88 is pressed against the contact surface FT due to the biasing force of the helical compression spring S1. This configuration may hold the pad 88 in position relative to the holder 86, and may stabilize the position of the nip portion NP if the nip forming member 85 should have manufacturing deviations, such as a positional deviation of the pad 88 relative to the plate member 89 (e.g., positional deviation caused when the pad 88 is attached to the plate member 89).

In addition to the advantages described above, the illustrative embodiment may have the following advantages. The helical compression spring S1 biases the nip forming member 85 toward the downstream wall 86C, which is disposed downstream of the nip forming member 85 in the belt moving direction. This configuration may prevent or reduce, in the nipped state, the nip forming member 85 from being moved by friction with the endless belt 83 against the biasing force of the helical compression spring S1.

The helical compression spring S1 biases the plate member 89 that is more rigid than the pad 88. This configuration may further stabilize the positions of the pad 88 and the nip portion NP.

The recess portion G of the downstream wall 86C receives the projecting portion C of the plate member 89, thereby preventing or reducing the nip forming member 85 from coming out of the holder 86.

The recess portion G has a dimension in the front-rear direction that is longer than the dimension of the projecting portion C in the front-rear direction, so that an end of the projecting portion C may not contact an interior end (e.g., a most recessed portion) of the recessed portion G. This configuration may allow the biasing force of the helical compression spring S1 to be effectively used as a force for pressing the pad 88 against the contact surface FT.

The helical compression spring S1 is supported by the stay 87, which is separate from the holder 86. This configuration may favorably bias the nip forming member 85 toward the downstream wall 86C of the holder 86.

The helical compression spring S1 is located to one side of the holder 86 in the right-left direction, so that the helical compression spring S1 may be attached readily.

The first boss C1 and the second boss C2 engage in an internal space of the helical compression spring S1 in its radial direction, thereby preventing or reducing the helical compression spring S1 from coming off from the plate member 89 or the stay 87. This configuration may hold the helical compression spring S1 securely with the bosses C1 and C2.

The helical compression spring S1 is disposed under a portion of the side guide 90 and is surrounded by the belt guide portion 92 of the side guide 90. This configuration may protect the helical compression spring S1 with the side guide 90.

One helical compression spring S1 is disposed at a respective left and right end portion of the plate member 89. This configuration may balance biasing forces applied by the helical compression springs S1 to the plate member 89.

While the disclosure has been described in detail with reference to the specific embodiment thereof, various changes, arrangements and modifications may be applied therein as will be described below Like numerals in the drawings denote like components and the detailed description of those components described above is omitted, with respect to FIGS. 8A-22B.

Figure 8A:
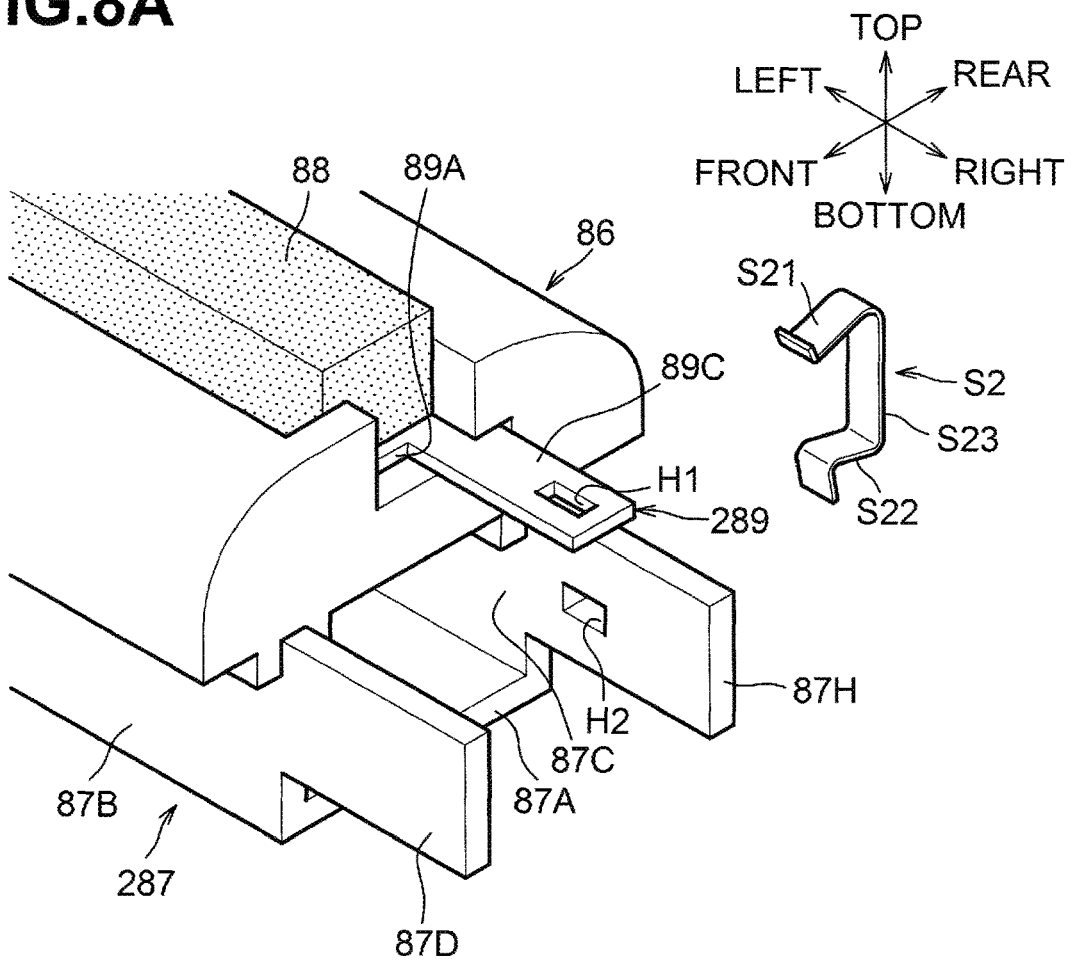
FIG. 8A is a perspective view of a pressure unit of a fuser according to a first modification.
Figure 8B:
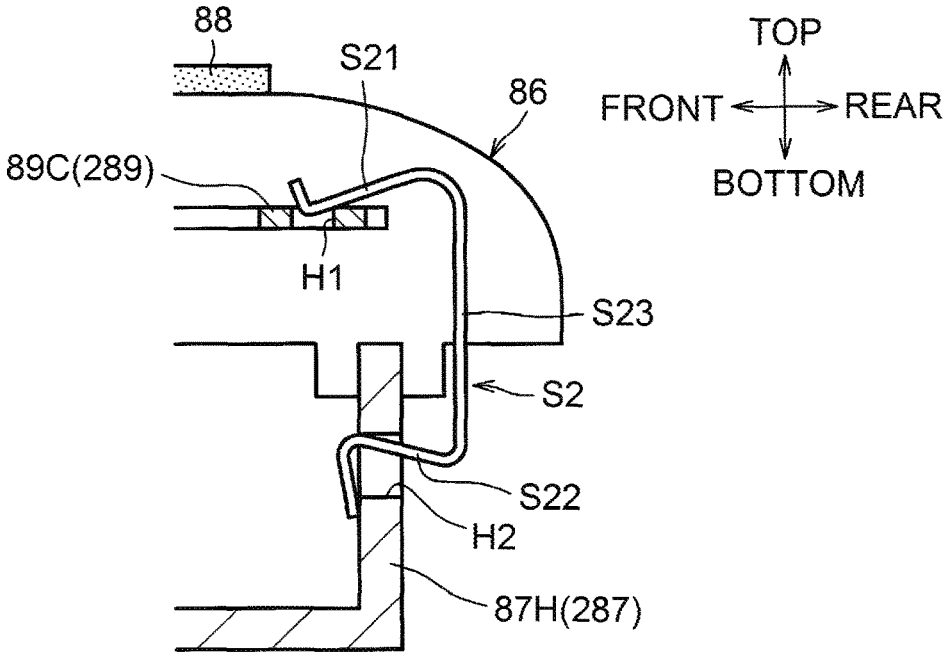
FIG. 8B is a cross-sectional view of the pressure unit of the fuser according to the first modification.

In the illustrative embodiment, the helical compression spring S1 serves as a biasing member. Examples of the biasing member may include heat resistant rubber and springs other than a helical compression spring. For example, a flat spring S2 as depicted in FIG. 8A, may serve as a biasing member. To use the flat spring S2 as a biasing member, the plate member 89 and the stay 87 in the illustrative embodiment may be modified into a plate member 289 and a stay 287 in a first modification, as depicted in FIGS. 8A and 8B.

The plate member 289 includes a base portion 89A similar to that in the illustrative embodiment, and an extended portion 89C, which is slightly different from the extended portion 89B in the illustrative embodiment. The extended portion 89C has a first engagement opening H1, e.g., a slot, instead of having the first boss C1 in the illustrative embodiment. The first engagement opening H1 receives or engages an end portion of the flat spring S2.

The stay 287 is different from the stay 87 of the illustrative embodiment in that the stay 287 does not include the protruding portion 87E as in the illustrative embodiment, and includes a downstream extended portion 87H, which is different from the downstream extended portion 87F in the illustrative embodiment. The downstream extended portion 87H has a second engagement opening H2 that receives or engages another end portion of the flat spring S2.

The flat spring S2 includes a base portion S23 extending in the top-bottom direction, a first spring leg portion S21 extending from an upper end of the base portion S23 toward the front, and a second spring leg portion S22 extending from a lower end of the base portion S23 toward the front. The spring leg portions S21 and S22 have bends so that their respective distal end portions (e.g., front end portions) extend away from each other in the top-bottom direction.

As depicted in FIG. 8B, the distal end portion of the first spring leg portion S21 engages in the first engagement opening H1 of the plate member 289 while the distal end portion of the second spring leg portion S22 engages in the second engagement opening H2 of the stay 287. The distal end portion of the first spring leg portion S21 engages the rear edge of the first engagement opening H1, to bias the plate member 289 toward the rear. This modification may also have advantages similar to those of the illustrative embodiment.

Figure 9:
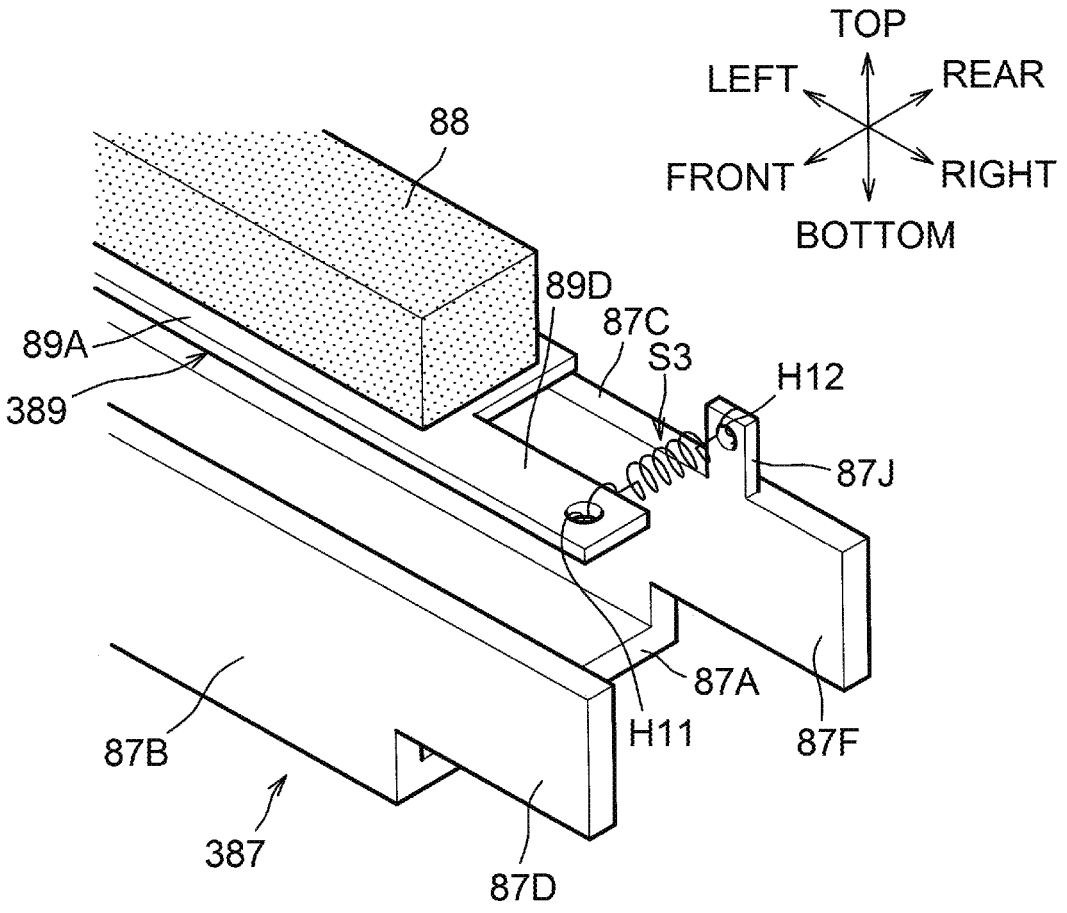
FIG. 9 is a perspective view of a pressure unit of a fuser according to a second modification.

Examples of the biasing member may include a tension spring, e.g., a helical tension spring S3, as depicted in FIG. 9. To use the helical tension spring S3 as a biasing member, the plate member 89 and the stay 87 in the illustrative embodiment may be modified into a plate member 389 and a stay 387 in a second modification, as depicted in FIG. 9.

The plate member 389 includes a base portion 89A, similar to that in the illustrative embodiment, and an extended portion 89D which is slightly different from the extended portion 89B in the illustrative embodiment. The extended portion 89D differs from the extended portion 89B of the illustrative embodiment, in that the extended portion 89D is disposed at a front end portion of the base portion 89A and includes a first engagement opening H11, e.g., a circular hole, which receives one end portion of the helical tension spring S3. In FIG. 9, although the holder 86 is omitted for clarity of illustration, the restriction wall 86D of the holder 86 may be, for example, spaced from the upstream wall 86B, in association with the position of the extended portion 89D. The restriction wall of the second modification may thus be located further to the rear than the restriction wall 86D of the illustrative embodiment.

The stay 387 is different from the stay 87 of the illustrative embodiment in that the stay 387 does not include the protruding portion 87E disposed at the upstream extended portion 87D as in the illustrative embodiment but includes a protruding portion 87J disposed at the downstream extended portion 87F. The protruding portion 87J includes a second engagement opening H12 that receives or engages another end portion of the helical tension spring S3. In the second modification, the helical tension spring S3 biases the plate member 389 toward the rear. This modification may also have advantages similar to those of the illustrative embodiment.

Figure 10A:
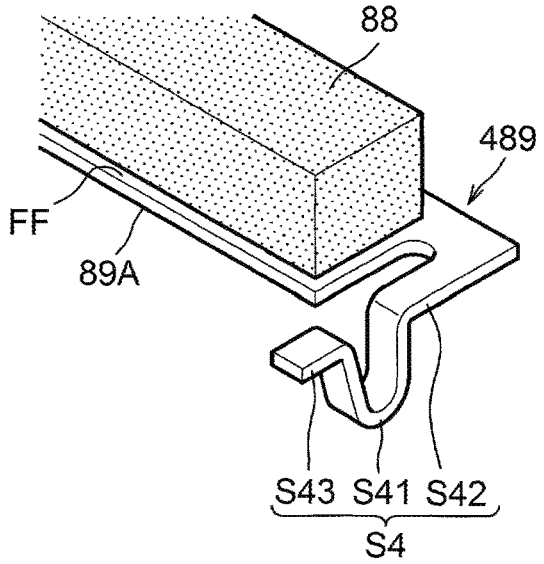
FIG. 10A is a perspective view of a nip forming member of a fuser according to a third modification.
Figure 10B:
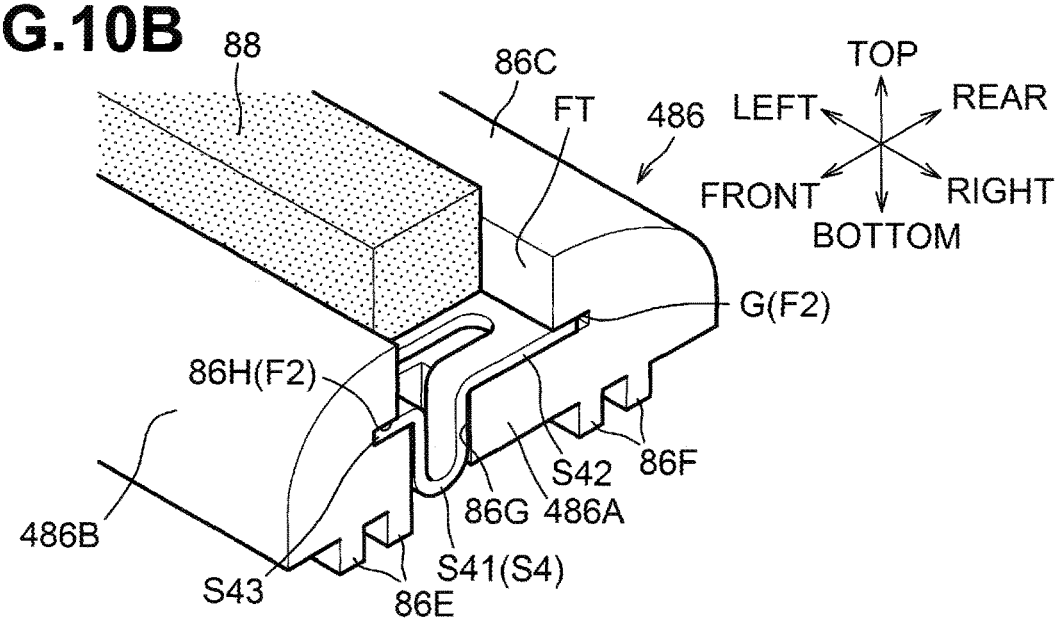
FIG. 10B is a perspective view of the nip forming member attached to a holder of the fuser according to the third modification.

As depicted in FIGS. 10A and 10B, examples of the biasing member may include a spring portion S4 integrally formed with a plate member 489. To use the spring portion S4 integral with the plate member 489 as a biasing member, the holder 86 in the illustrative embodiment may be modified into a holder 486 in a third modification as depicted in FIGS. 10A-10C.

Figure 10C:
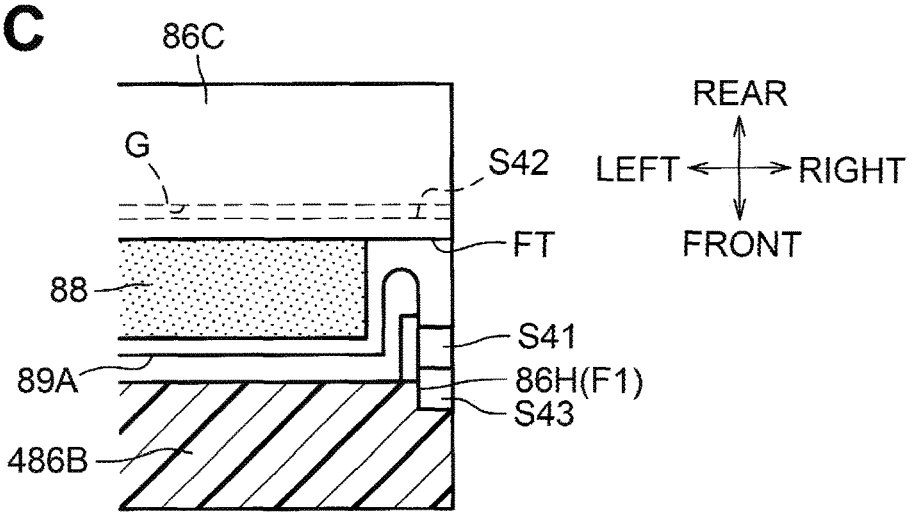
FIG. 10C is a partially-cutaway top plan view of a pressure unit of the fuser according to the third modification.

The plate member 489 includes a base portion 89A similar to that in the illustrative embodiment, and a spring portion S4 disposed at a respective right and left end portions of the base portion 89A (the left spring portion S4 not depicted in FIGS. 10A-10C).

The base portion 89A has an attachment surface FF to which the pad 88 is attached.

The attachment surface FF is a surface of the rectangular-shaped base portion 89A closer to the heat roller 81 or an upper surface of the base portion 89A.

The spring portion S4 includes an elastically deformable portion S41, a connected portion S42 located to the rear of the deformable portion S41, and a contact portion S43 located to the front of the deformable portion S41. The deformable portion S41 is a flat spring having a "V" shape in cross section, and deformable in the front-rear direction.

The deformable portion S41 is located farther from the heat roller 81 than the pad 88 in the top-bottom direction. In other words, the deformable portion S41 protrudes from the connected portion S42 downward in a direction away from the pad 88.

The connected portion S42 extends rearward from the deformable portion S41 and then leftward and connects to the base portion 89A having the attachment surface FF. A rear end portion of the connected portion S42 and a rear end portion of the base portion 89A engage in the recess portion G of the holder 486. The contact portion S43 extends frontward from the deformable portion S41 and contacts the holder 486.

The holder 486 is different from the holder 86 of the illustrative embodiment in that the holder 486 does not include the restriction wall 86D, and includes a base portion 486A and an upstream wall 486B, which are slightly different from the base portion 86A and the upstream wall 86B of the illustrative embodiment, respectively. The base portion 486A includes an opening 86G configured to receive the deformable portion S41. The opening 86G extends through the base portion 486A in the top-bottom direction and have an open right end.

The upstream wall 486B includes an engagement recess portion 86H that engages the contact portion S43 of the spring portion S4. The engagement recess portion 86H has an open rear end and an open right end. The engagement recess portion 86H includes a second restriction surface F2 that restricts the upward movement of the spring portion S4 (e.g., movement in a direction from the nip forming member 85 toward the heat roller 81).

The recess portion G also has a second restriction surface F2 that restricts the upward movement of the spring portion S4. As depicted in FIG. 10C, the engagement recess portion 86H has a first restriction surface F1 that restricts the sideways movement (e.g., leftward movement) of the spring portion S4. In the third modification, the engagement recess portion 86H has the first restriction surface F1. Alternatively, for example, the opening 86G, may have a first restriction surface.

The third modification may have the following advantages. The deformable portion S41 is located farther from the heat roller 81 than the pad 88 in the top-bottom direction. This configuration may prevent or reduce the deformable portion S41 from contacting the endless belt 83, for example, as compared with a configuration in which a deformable portion protrudes in a direction toward the pad 88.

The first restriction surface F1 restricts the sideways movement (e.g., leftward movement) of the spring portion S4 in the right-left direction. This configuration may hold the plate member 489 in position relative to the holder 486 in the right-left direction.

The holder 486 includes the engagement recess portion 86H that engages the contact portion S43 of the spring portion S4. The contact portion S43 may be inserted into the recess portion 86H while the spring portion S4 is being compressed. The plate member 489 may thus be attached or mounted to the holder 486 readily.

The second restriction surface F2 may restrict the movement of the spring portion S4 in the direction from the nip forming member 85 toward the heat roller 81. This configuration may prevent or reduce the plate member 489 from coming out of the holder 486.

Although the fuser 8 includes one nip forming member 85 in the illustrative embodiment, the fuser 8 may include, for example, two, nip forming members.

A fourth modification in which a fuser 8 includes two nip forming members will be described referring to FIG. 11. The fuser 8 may include a nip forming member 85, and another nip forming member X separate from the nip forming member 85. The nip forming member X may have configuration similar to that of the nip forming member 85.

Figure 11:
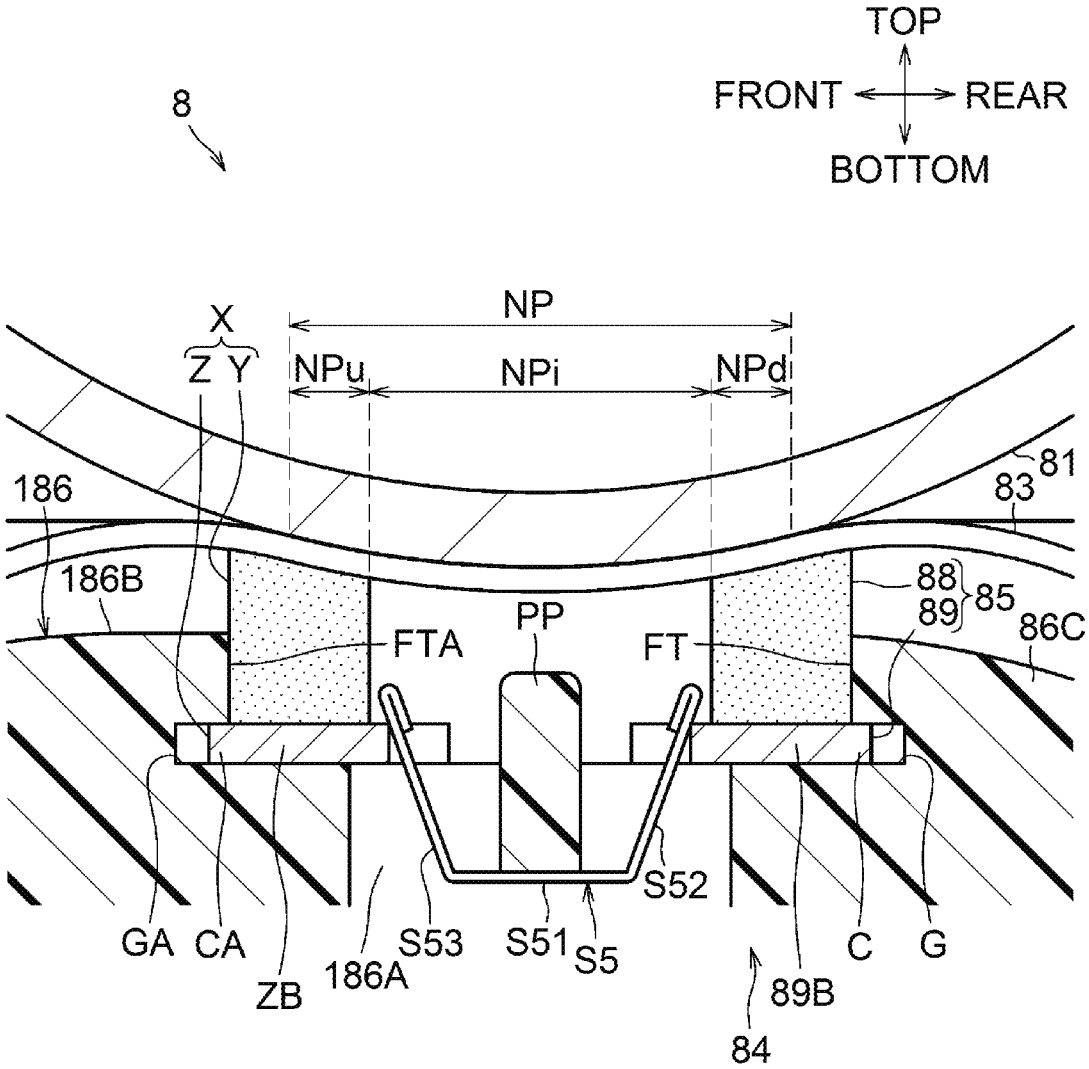
FIG. 11 is a cross-sectional view of a pressure unit of a fuser according to a fourth modification.

As depicted in FIG. 11, the fuser 8 further includes a flat spring S5, as an example of a biasing member and a second biasing member, and a holder 186 that is slightly different from the holder 86 of the illustrative embodiment.

The nip forming member X is configured to nip the endless belt 83 in cooperation with the heat roller 81 such that an upstream nip portion NPu is formed between the heat roller 81 and the endless belt 83. The nip forming member X is located within a loop or an internal space of the endless belt 83. The nip forming member X is disposed upstream of the nip forming member 85 in the belt moving direction. The nip forming member 85 is configured to nip the endless belt 83 in cooperation with the heat roller 81 such that a downstream nip portion NPd is formed between the heat roller 81 and the endless belt 83. In the fourth modification, the nip forming member X is spaced from the nip forming member 85 in the belt moving direction. This configuration may create an intermediate nip portion NPi between the upstream nip portion NPu and the downstream nip portion NPd. A pressure unit 84 according to the fourth modification does not include, at the intermediate nip portion NPi, members or components that nip the endless belt 83 in cooperation with the heat roller 81. Accordingly, less pressure may be applied by the pressure unit 84 to the intermediate nip portion NPi. This configuration may allow the sheet S passing through the intermediate nip portion NPi to receive heat from the heat roller 81 without receiving much pressure from the pressure unit 84. The nip portion NP in the fourth modification is a portion where an outer peripheral surface of the endless belt 83 contacts the heat roller 81. The nip portion NP may range from an upstream end of the upstream nip portion NPu to a downstream end of the downstream nip portion NPd. In the fourth modification, a state in which the nip portion NP is formed, as depicted in FIG. 11, is referred to as a "nipped state", and a state in which the nip portion NP is not formed is referred to as a "nip released state".

The nip forming member X includes a pad Y and a plate member Z. The pad Y is configured to nip the endless belt 83 in cooperation with the heat roller 81 between the pad Y and the heat roller 81 and to press the endless belt 83 against the heat roller 81. The pad Y is fixed to the plate member Z. The pad Y is similar to the pad 88 in the illustrative embodiment.

The plate member Z is similar to the plate member 89 in the illustrative embodiment.

Figure 12:
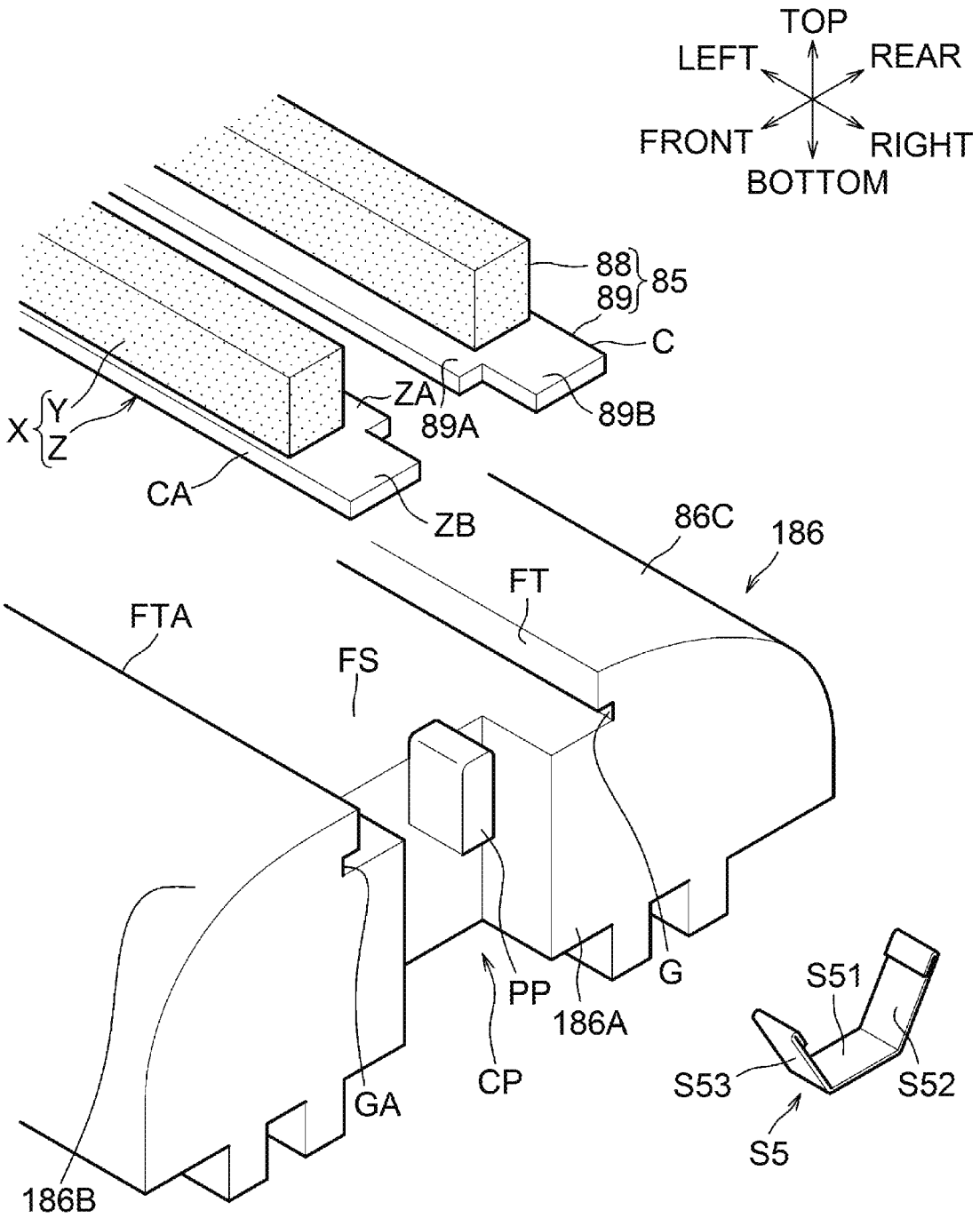
FIG. 12 is a perspective view of the pressure unit of the fuser according to the fourth modification.

In one example, as depicted in FIG. 12, the plate member Z includes a projecting portion CA, a base portion ZA, and an extended portion ZB. The projecting portion CA is similar to the projecting portion C of the plate member 89. The base portion ZA is similar to the base portion 89A. The extended portion ZB is similar to the extended portion 89B. The extended portion ZB of the plate member Z is located at a front end portion of the base portion ZA.

The holder 186 is slightly different from the holder 86 of the illustrative embodiment.

The holder 186 includes an upstream wall 186B and a base portion 186A, which are slightly different from the upstream wall 86B and the base portion 86A, respectively. The upstream wall 186B is an example of a restricting member.

The upstream wall 186B includes a contact surface FTA and a recess portion GA that are disposed at a rear (e.g., downstream) portion of the upstream wall 186B. The contact surface FTA may contact the pad Y in the belt moving direction. The contact surface FTA is orthogonal to the belt moving direction. The contact surface FTA faces rearward or downstream in the belt moving direction. The recess portion GA is recessed into the contact surface FTA toward the front.

The recess portion GA is grooved to allow the projecting portion CA of the plate member Z to engage therein. The recess portion GA extends through the upstream wall 186B in the right-left direction. The recess portion GA has a depth (e.g., a distance in the front-rear direction) that is greater than a projecting amount of the projecting portion CA relative to the pad Y in the front-rear direction. In other words, the relation between the depth of the recess portion GA and the projecting amount of the projecting portion CA in the belt moving direction relative to the pad Y is the same as the relation between the depth of the recess portion G and the projecting amount of the projecting portion C relative to the pad 88 in the belt moving direction.

The base portion 186A includes a support surface FS that supports the plate members 89 and Z to allow the plate members 89 and Z to slidably move in the belt moving direction or the front-rear direction. The base portion 186A further includes a recess portion CP and a projection PP. The recess portion CP is recessed into the base portion 186A from a right end of the base portion 186A. The projection PP is located in the recess portion CP, and projects rightward from a most recessed portion of the recess portion CP.

The flat spring S5 is received in a space in the recess portion CP while the upward movement of the flat spring S5 is restricted by the projection PP.

The flat spring S5 may include resin or metal. The flat spring S5 includes a base portion S51, an arm portion S52, and another arm portion S53. The base portion S51 connects the two arm portions S52 and S53 to each other. The base portion S51 is located below the projection PP.

The arm portion S52 engages with the extended portion 89B of the plate member 89.

The arm portion S52 extends upward from a rear end of the base portion S51, such that a top portion of the arm portion S52 extends further toward the rear than a bottom portion of the arm portion S52.

The arm portion S53 engages with the extended portion ZB of the plate member Z. The arm portion S53 extends upward from a front end of the base portion S51, such that a top portion of the arm portion S53 extends further toward the front than a bottom portion of the arm portion S53.

Figure 13:
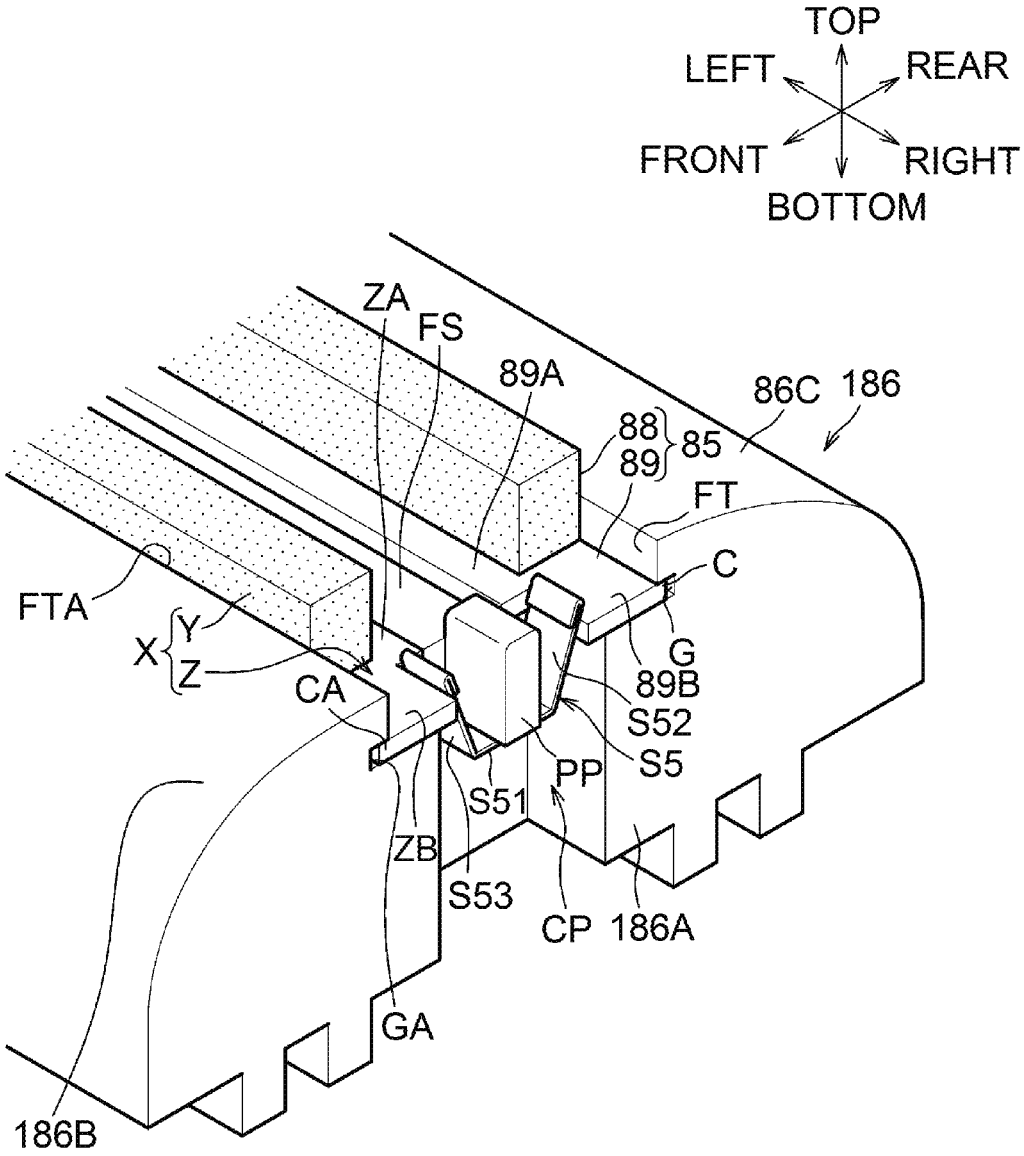
FIG. 13 is a perspective view of the pressure unit of the fuser according to the fourth modification.

As depicted in FIG. 13, the flat spring S5 is compressed between the extended portion 89B of the plate member 89 and the extended portion ZB of the plate member Z, thereby biasing, in the belt moving direction, the plate member 89 toward the downstream wall 86C and the plate member Z toward the upstream wall 186B. In the fourth modification, the biasing member that biases the plate member 89 and the second biasing member that biases the plate member Z are integrated into one flat spring S5.

The flat spring S5 compressed between the extended portion 89B of the plate member 89 and the extended portion ZB of the plate member Z tends to move upward due to its restoring force. Since the base portion S51 of the flat spring S5 contacts the projection PP, the upward movement of the flat spring S5 may be restricted. This configuration may prevent or reduce the flat spring S5 from coming off from the plate members 89 and Z.

In the nipped state as depicted in FIG. 11, the plate members 89 and Z are biased by the flat spring S5 toward the respective walls 86C and 186B. Accordingly, the pads 88 and Y may contact or abut against the respective walls 86C and 186B, thereby restricting the movements of the nip forming members 85 and X. In the nip released state, the pads 88 and Y may also contact or abut against the respective walls 86C and 186B and movements of the nip forming members 85 and X may be restricted. If the endless belt 83 is repeatedly nipped or released, the nip forming members 85 and X may be held in position relative to the holder 186. This may stabilize the positions of the upstream nip portion NPu and the downstream nip portion NPd, as well as the nip portion NP. The pads 88 and Y may contact or abut against the respective walls 86C and 186B due to the biasing force of the flat spring S5. This configuration may hold the pads 88 and Y in position relative to the holder 186 and may stabilize the position of the nip portion NP if the nip forming members 85 and X should have manufacturing deviations, such as a positional deviation of the pads 88 and Y relative to the respective plate members 89 and Z (e.g., positional deviation caused when the pads 88 and Y are attached to the plate members 89 and Z).

In the fourth modification, the biasing member and the second biasing member are integrated into one flat spring S5. This configuration may reduce the number of components and costs of the fuser 8.

Figure 14:
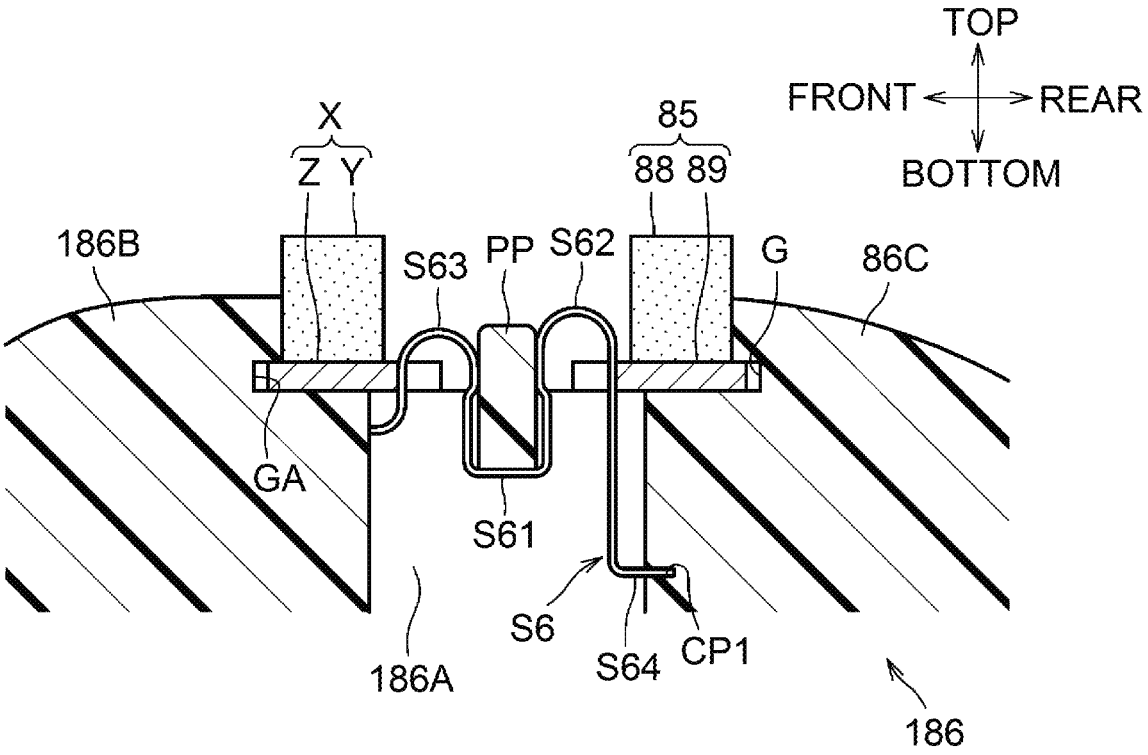
FIG. 14 is a cross-sectional view of a pressure unit of a fuser according to a fifth modification.

A fifth modification will now be described referring to FIGS. 14 and 15. In the fifth modification, the biasing member and the second biasing member may be integrated into one flat spring S6, which is different from the flat spring S5 of the fourth modification as depicted in FIG. 11.

Figure 15:
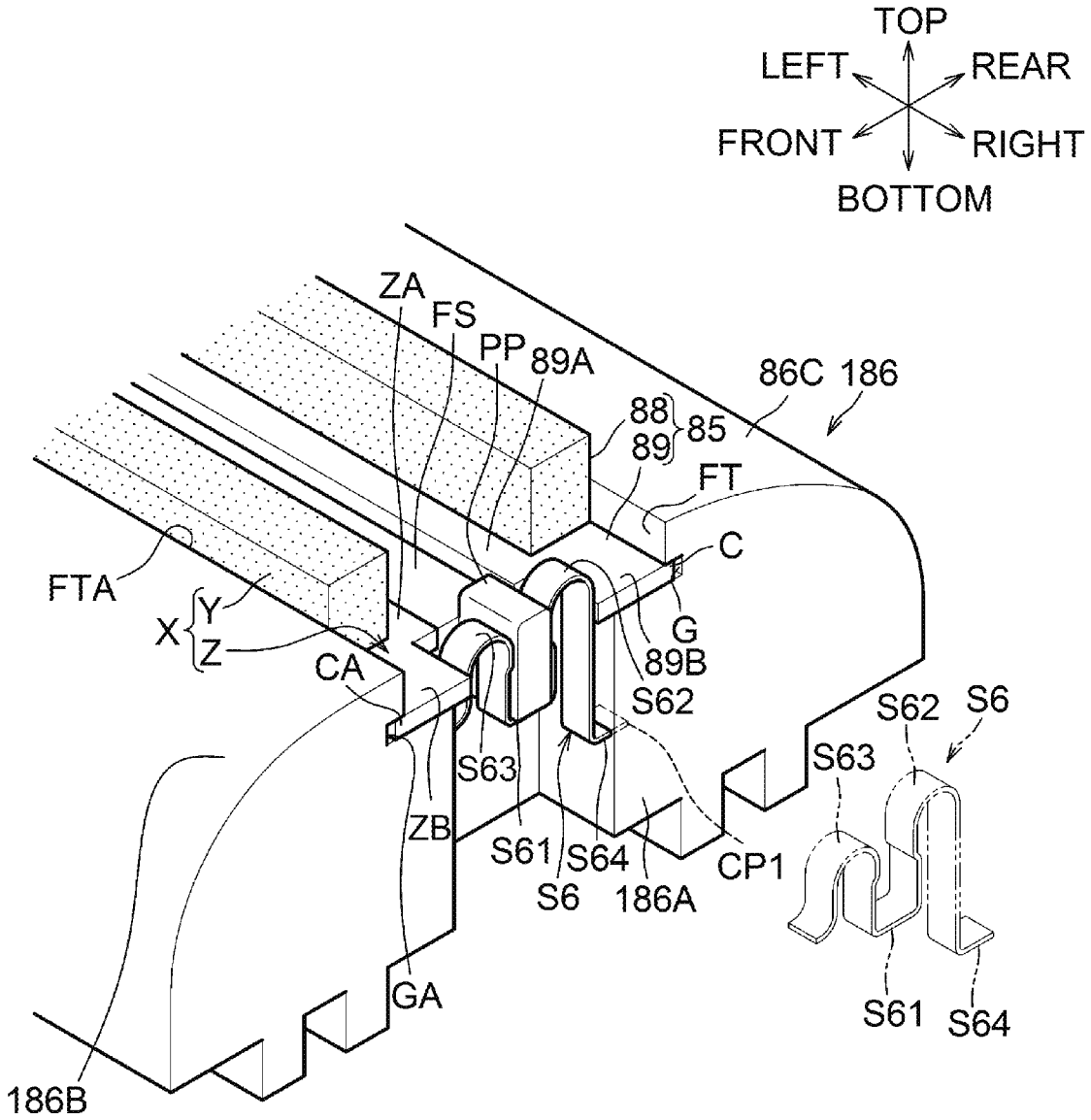
FIG. 15 is a perspective view of the pressure unit of the fuser according to the fifth modification.

A holder 186 according to the fifth modification is different from that of the fourth embodiment, in that the holder 186 according to the fifth modification has a downstream wall 86C having a recess portion CP1, as depicted in FIG. 15.

The flat spring S6 may include resin or metal. The flat spring S6 includes a base portion S61, a spring portion S62, another spring portion S63, and an engaging portion S64. The base portion S61 connects two spring portions S62 and S63 to each other. The base portion S61 is located below the projection PP.

The spring portion S62 biases the plate member 89 toward the downstream wall 86C. The spring portion S62 has a U-shaped cross section with an open end facing downward.

The spring portion S62 extends upward from a rear end of the base portion S61 and then extends downward while making a U-turn. A rear portion of the spring portion S62 extends downward below the base portion S61. The spring portion S62 is disposed between the plate member 89 and the projection PP while being compressed in the belt moving direction.

The spring portion S63 biases the plate member Z toward the upstream wall 186B. The spring portion S63 has a U-shaped cross section with an open end facing downward. The spring portion S63 extends upward from a front end of the base portion S61 and then extends downward while making a U-turn. The spring portion S63 is disposed between the plate member Z and the projection PP while being compressed in the belt moving direction.

The engaging portion S64 engages the holder 186. The engaging portion S64 extends rearward from a lower end of the spring portion S62. The downstream wall 86C has the recess portion CP1 that receives the engaging portion S64. The flat spring S6 of the fifth modification also biases the nip forming members 85 and X toward the respective walls 86C and 186B.

Figure 16:
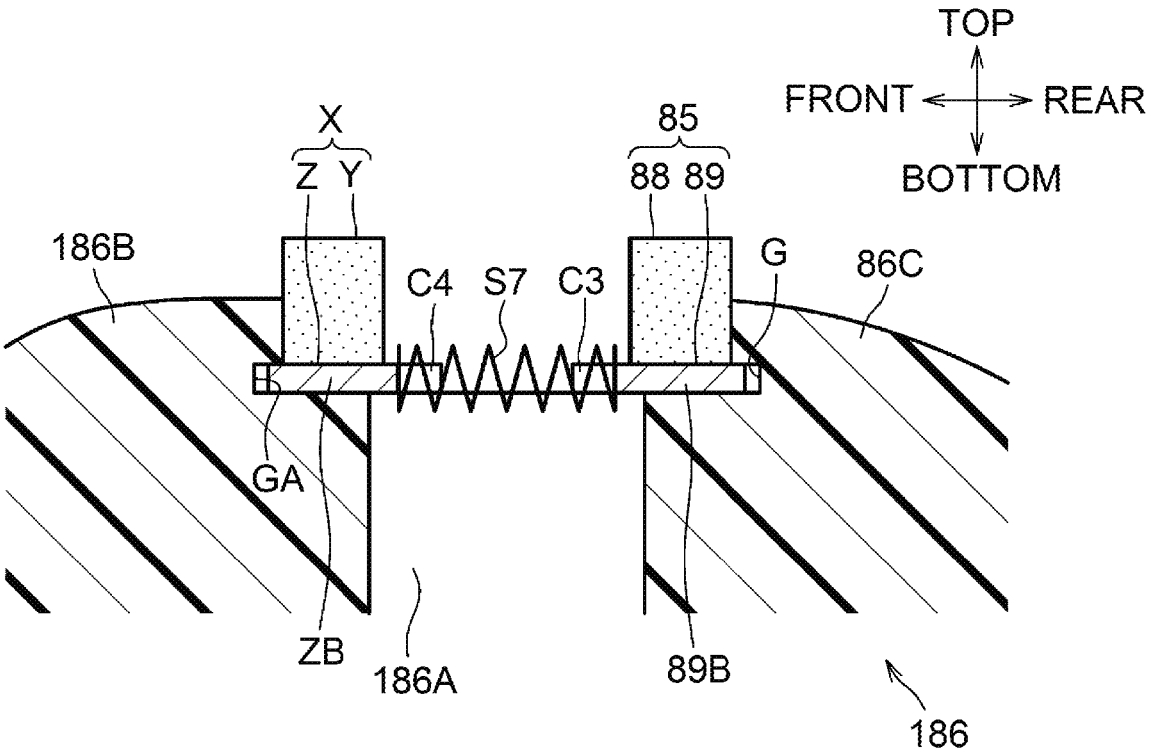
FIG. 16 is a cross-sectional view of a pressure unit of a fuser according to a sixth modification.
Figure 17:
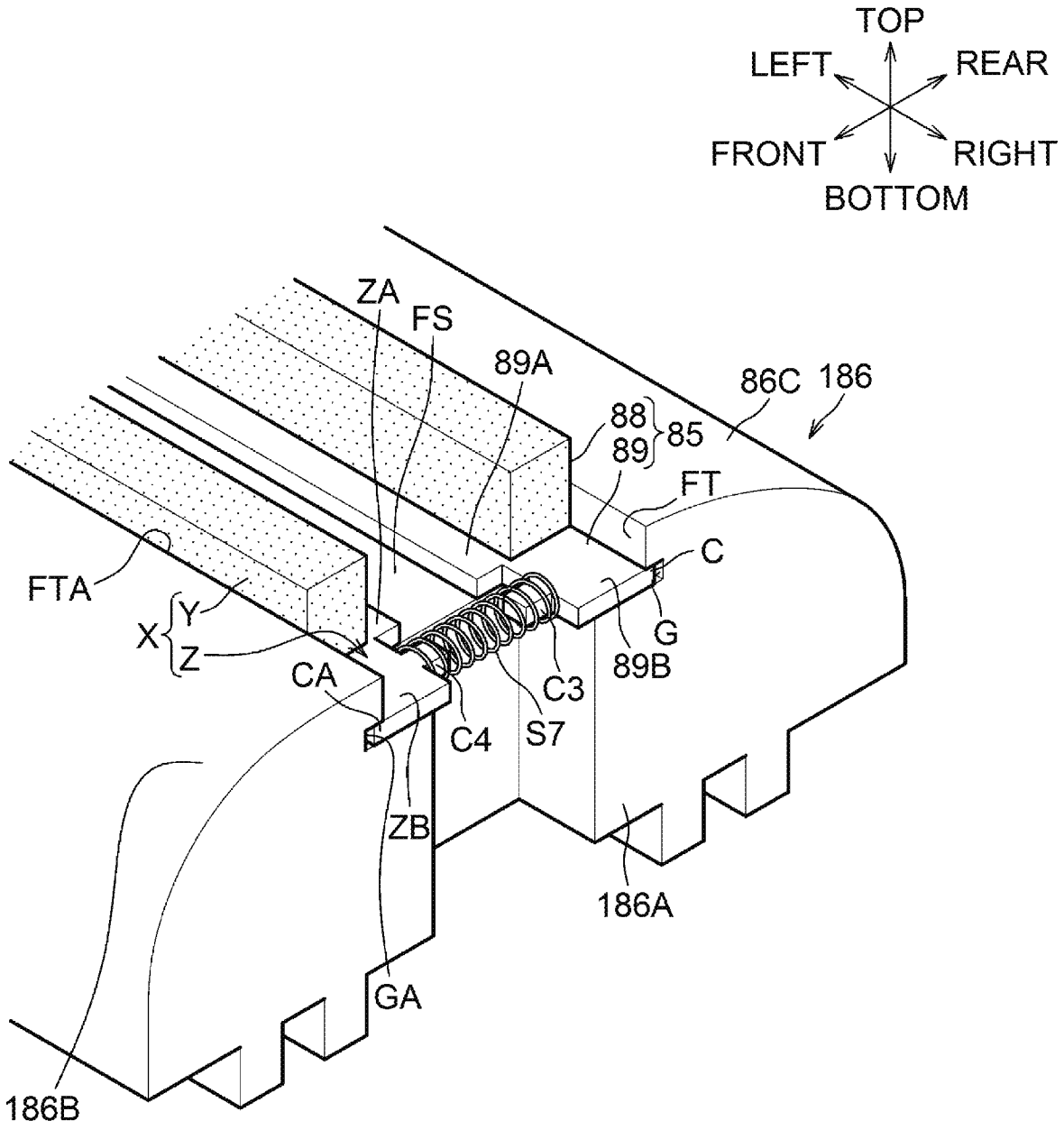
FIG. 17 is a perspective view of the pressure unit of the fuser according to the sixth modification.

A sixth modification will now be described referring to FIGS. 16 and 17. In the sixth modification, a helical compression spring S7 may be disposed between plate members 89 and Z in a compressed state. The helical compression spring S7 biases the nip forming member 85 toward the downstream wall 86C and biases the nip forming member X toward the upstream wall 186B. The sixth modification does not require the projection PP, so that a holder 186 of the sixth modification does not have the projection PP. To hold the helical compression spring S7 between the plate members 89 and Z, the plate members 89 and Z have bosses C3 and C4, respectively. The bosses C3 and C4 are sized to engage in an internal space of the helical compression spring S7 in its diametrical direction.

A seventh modification will now be described referring to FIGS. 18A and 18B. In the seventh modification, two nip forming members 585 and X1 may be biased in a direction toward each other, unlike the fourth to sixth modifications, as depicted in FIGS. 11-17, in which two nip forming members 85 and X are biased in a direction away from each other.

The nip forming member 585 includes a pad 88, which is similar to that of the fourth modification as depicted in FIG. 11, and a plate member 589, which is slightly different from the plate member 89 of the fourth modification. The plate member 589 of this seventh modification includes components similar to those of the plate member 89 of the fourth modification. However, arrangements of the components are different between the fourth modification and the seventh modification. More specifically, the plate member 589 includes a base portion 89A and an extended portion 89B, which are similar to those of the fourth modification. The extended portion 89B is located at a front end portion of the base portion 89A, unlike the fourth modification.

The nip forming member X1 includes a pad Y, which is similar to that of the fourth modification, and a plate member Z1, which is slightly different from the plate member Z of the fourth modification. The plate member Z1 of this seventh modification has components similar to those of the plate member Z of the fourth embodiment. However, arrangements of the components are different between the fourth modification and the seventh modification. More specifically, the plate member Z1 includes a base portion ZA and an extended portion ZB, which are similar to those of the fourth modification. The extended portion ZB is located at a rear end portion of the base portion ZA, unlike the fourth modification.

The holder 186 includes a projection PP1 that extends upward from the support surface FS of the holder 186. The projection PP1 extends in the right-left direction from an end (e.g., right end) of the holder 186 to an opposite end (e.g., left end) of the holder 186. The projection PP1 has recess portions GB and GC. The recess portion GB receives a front (e.g., upstream) end of the plate member 589. The recess portion GC receives a rear (e.g., downstream) end of the plate member Z1. The pad 88 is disposed relative to the plate member 589 such that, when the pad 88 is in contact with the projection PP1, the front end of the plate member 589 does not contact an interior end (e.g., a most recessed portion) of the recessed portion GB. The pad Y is disposed relative to the plate member Z1 such that, when the pad Y is in contact with the projection PP1, the rear end of the plate member Z1 does not contact an interior end (e.g., a most recessed portion) of the recess portion GC. The projection PP1 is an example of a restricting member.

The nip forming members 585 and X1 are biased by a flat spring S8 toward the projection PP1. The flat spring S8 includes a base portion S81, a spring portion S82, and another spring portion S83.

The base portion S81 connects the two spring portions S82 and S83 to each other. The base portion S81 includes a flat portion extending in the front-rear direction or the belt moving direction, a slanting portion extending upward and rearward from a rear end of the flat portion, and another slanting portion extending upward and frontward from a front end of the flat portion. At least a portion of the base portion S81 is disposed below the projection PP1.

The spring portion S82 biases the plate member 589 toward the projection PP1. The spring portion S82 has a U-shaped cross section with an open end facing downward. The spring portion S82 extends upward from a rear end of the base portion S81 and then extends downward while making a U-turn. The spring portion S82 is disposed between the plate member 589 and the downstream wall 86C while being compressed in the belt moving direction.

The spring portion S83 biases the plate member Z1 toward the projection PP1. The spring portion S83 has a U-shaped cross section with an open end facing downward. The spring portion S83 extends upward from a front end of the base portion S81 and then extends downward while making a U-turn. The spring portion S83 is disposed between the plate member Z1 and the upstream wall 186B while being compressed in the belt moving direction. In the seventh modification, the nip forming members 585 and X1 are biased toward the projection PP1, so that the pads 88 and Y may contact or abut against the projection PP1. This may achieve effects similar to those of the illustrative embodiment.

An eighth modification will now be described referring to FIGS. 19A and 19B. In the eighth modification, two nip forming members 685 and X2 may be biased toward a projection PP1 by a helical tension spring S9, which is different from the flat spring S8, of the seventh modification, that biases the two nip forming members 585 and X1 toward the projection PP1.

Figure 18A:
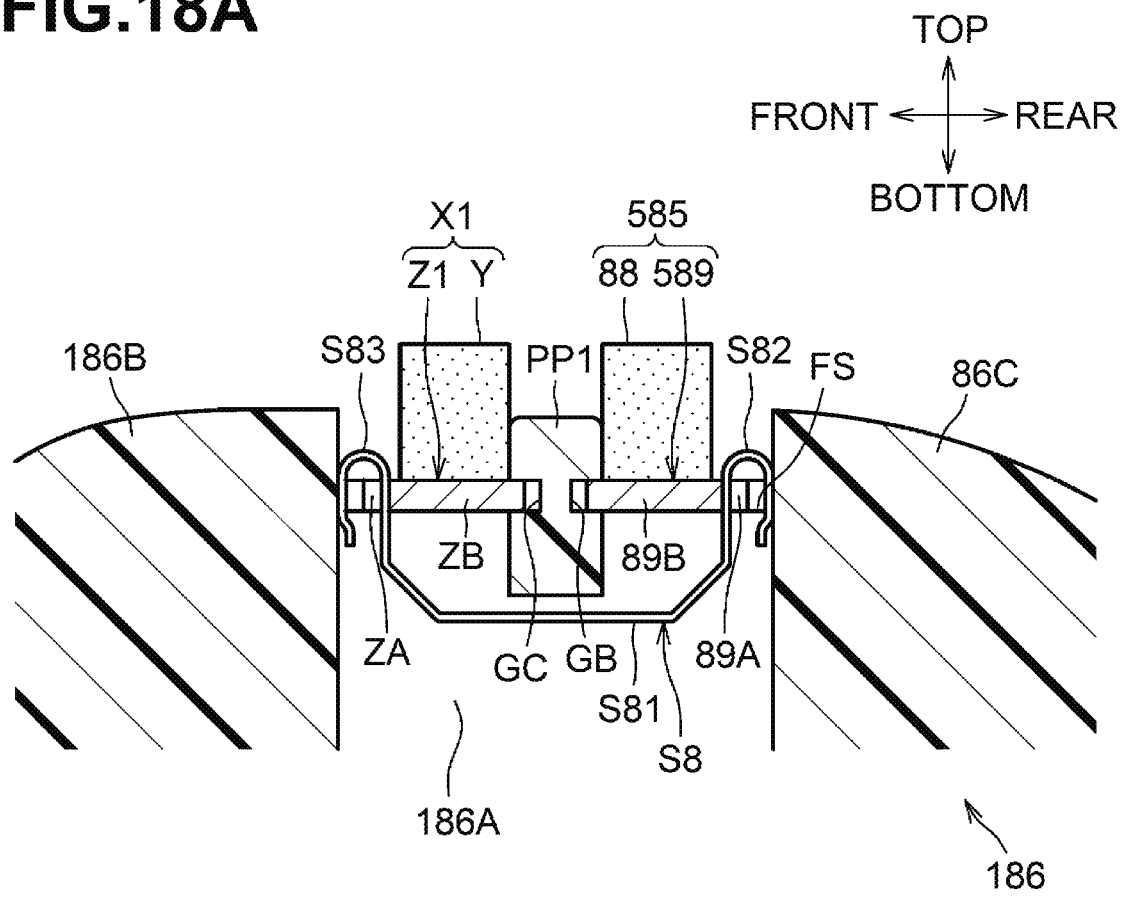
FIG. 18A is a cross-sectional view of a pressure unit of a fuser according to a seventh modification.
Figure 18B:
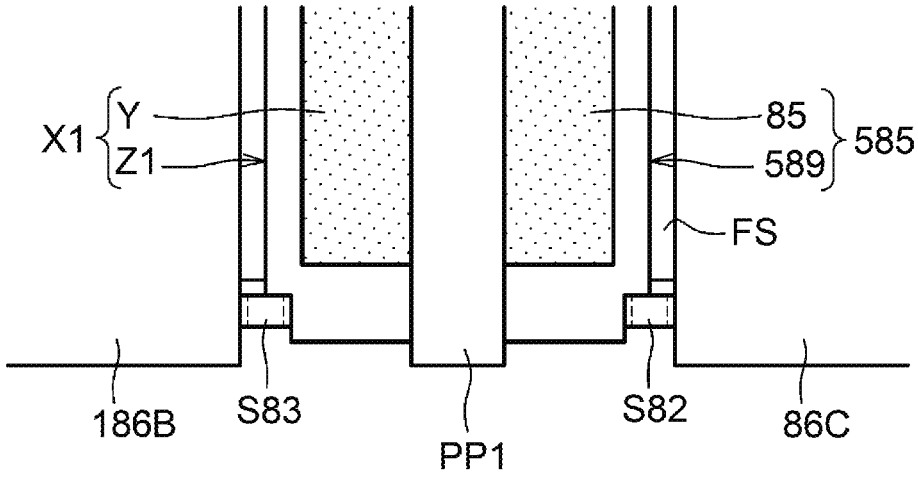
FIG. 18B is a top plan view of the pressure unit of the fuser according to the seventh modification.

In the eighth modification, the nip forming member 685 includes a pad 88, which is similar to that of the seventh modification as depicted in FIGS. 18A and 18B, and a plate member 689, which is slightly different from the plate member 585 of the seventh modification. The plate member 689 includes a base portion 89A, which is similar to that of the seventh modification, an extended portion 689B, and another extended portion 689C.

The extended portion 689B engages with an end of the helical tension spring S9. The extended portion 689B extends rightward from a right end of the base portion 89A.

The extended portion 689C serves to prevent the end of the helical tension spring S9 from coming out of the extended portion 689B. The extended portion 689C extends in the front-rear direction from a right end of the extended portion 689B.

The nip forming member X2 includes a pad Y, which is similar to that of the seventh modification, and a plate member Z2, which is slightly different from the plate member Z1 of the seventh modification. The plate member Z2 includes a base portion ZA, which is similar to that of the fourth modification as depicted in FIG. 12, an extended portion Z21, and another extended portion Z22. The extended portions Z21 and Z22 are similar to the extended portion 689B and the extended portion 689C, respectively. The extended portion Z21 engages with an opposite end of the helical tension spring S9. The extended portion Z22 serves to prevent the opposite end of the helical tension spring S9 from coming out of the extended portion Z21. The eighth modification may also enable the two nip forming members 685 and X2 to be biased toward the projection PP 1.

Figure 20:
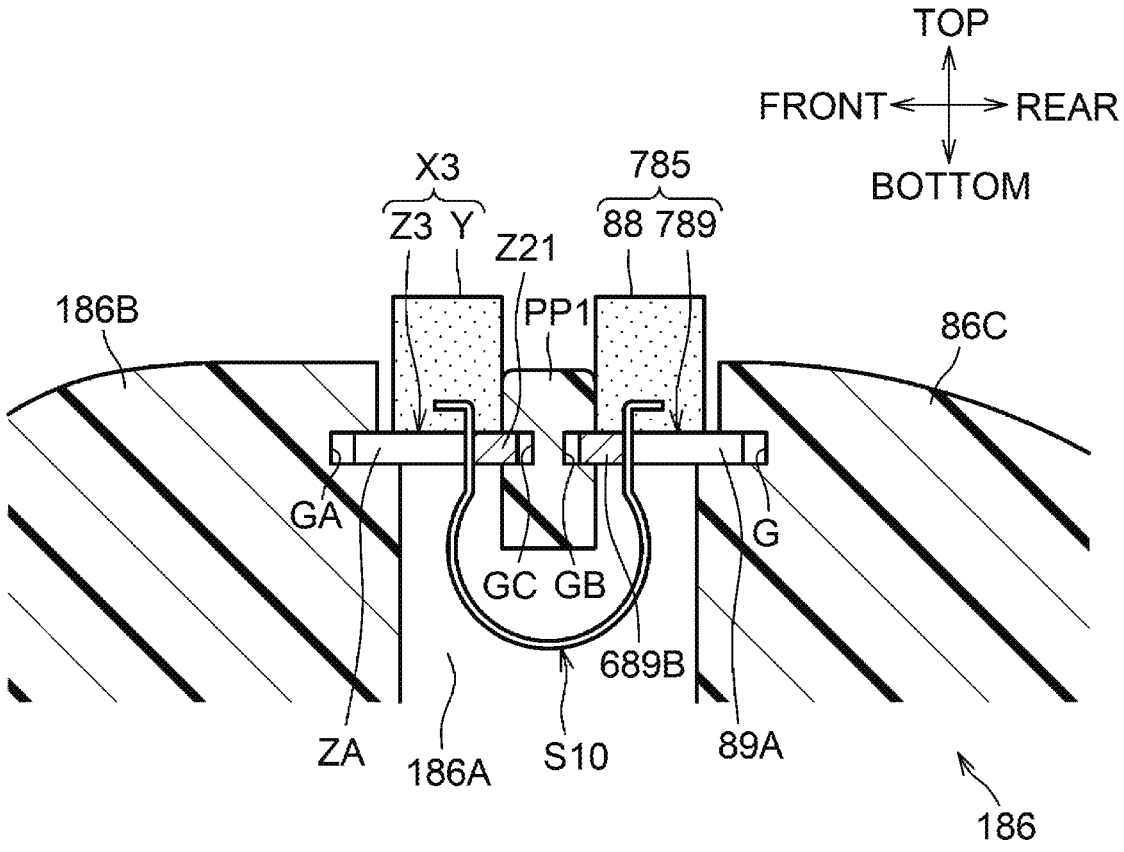
FIG. 20 is a cross-sectional view of a pressure unit of a fuser according to a ninth modification.

A ninth modification will now be described referring to FIG. 20. In the ninth modification, two nip forming member 785 and X3 may be biased toward the projection PP1 by a flat spring S10.

Figure 19A:
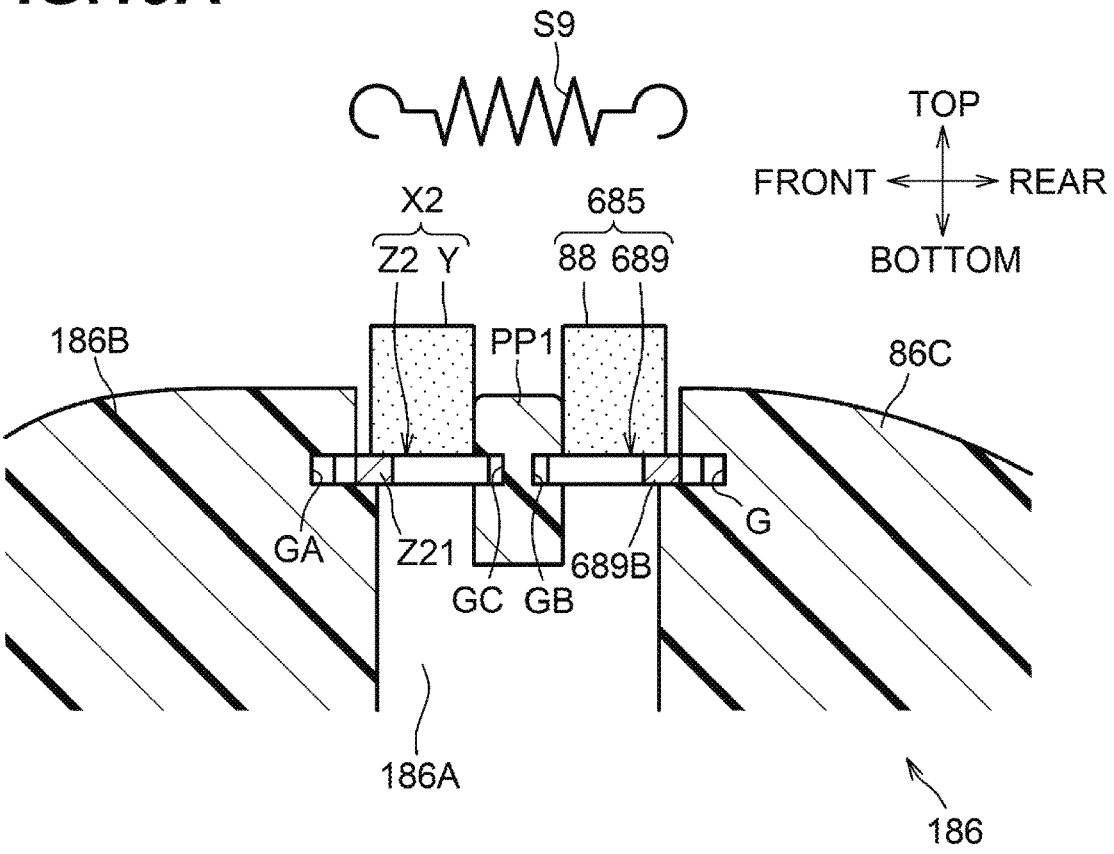
FIG. 19A is a cross-sectional view of a pressure unit of a fuser according to an eighth modification.
Figure 19B:
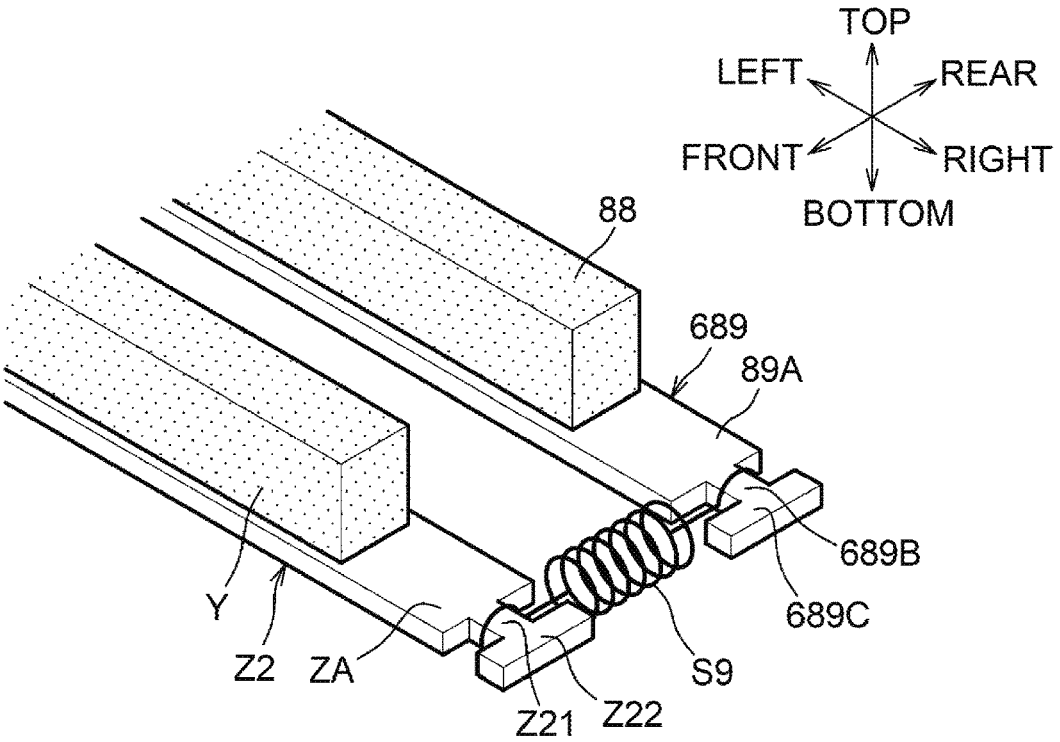
FIG. 19B is a perspective view of a portion of the pressure unit of the fuser according to the eighth modification, illustrating a helical compression spring and its surrounding components.

The nip forming member 785 includes a pad 88, which is similar to that of the eighth modification as depicted in FIGS. 19A and 19B, and a plate member 789, which is slightly different from the plate member 689 of the eighth modification. The plate member 789 includes a base portion 89A, which is similar to that of the eighth modification, an extended portion 689B and another extended portion 689C (not depicted). The extended portion 689B extends rightward from a right end of the base portion 89A, similar to the extended portion 689B of the eighth modification. The extended portion 689B is located at a front end portion of the base portion 89A, unlike the eighth modification.

The nip forming member X3 includes a pad Y, which is similar to that of the eighth modification, and a plate member Z3, which is slightly different from the plate member Z2 of the eighth modification. The plate member Z3 includes a base portion ZA, which is similar to that of the eighth modification, an extended portion Z21 and another extended portion Z22 (not depicted). The extended portion Z21 extends rightward from a right end of the base portion ZA, similar to the extended portion Z21 of the eighth modification. The extended portion Z21 is located at a rear end portion of the base portion ZA, unlike the eighth modification.

The flat spring S10 has a U-shaped cross section. The flat spring S10 has a rear end engaging with the extended portion 689B of the plate member 789 and a front end engaging with the extended portion Z21 of the plate member Z3. The ninth modification may also enable the nip forming members 785 and X3 to be biased toward the projection PP1.

A tenth modification will now be described referring to FIGS. 21A and 21B. In the tenth modification, two nip forming members 885 and X1 may be biased by a flat spring S11 toward the rear or a downstream side in the belt moving direction. The nip forming member 885 is slightly different from the nip forming member 85 of the illustrative embodiment as depicted in FIG. 3. The nip forming member X1 is similar to the nip forming member X1 of the seventh modification as depicted in FIGS. 18A and 18B.

The nip forming member 885 includes a pad 88, which is similar to that of the illustrative embodiment (in FIG. 3) and a plate member 889, which is slightly different from the plate member 89 of the illustrative embodiment. The plate member 889 includes a base portion 89A and an extended portion 89B, which are similar to those of the illustrative embodiment, but does not include the first boss C1, which the plate member 89 of the illustrative embodiment includes. The nip forming member X1 of the tenth modification includes a plate member Z1 including an extended portion ZB. The extended portion ZB is located at a position different from the extended portion 89B of the plate member 889 in the right-left direction.

The holder 186 includes a projection PP2 that is elongated in the right-left direction, similar to the projection PP1 of the seventh modification as depicted in FIGS. 18A and 18B. Unlike the projection PP1 of the seventh modification, the projection PP2 has a stepped portion PP21 at an end thereof in the right-left direction (e.g., a right end), so that a base portion S111 (described below) of the flat spring S11 may not interfere with the stepped portion PP21. The projection PP2 is an example of a restricting member.

The projection PP2 includes a recess portion GC, which is similar to that of the seventh modification, but does not include a recess portion GB. The flat spring S11 includes the base portion S111, a spring portion S112, and another spring portion S113.

The spring portion S112 biases the plate member 889 toward the downstream wall 86C. The spring portion S112 has a U-shaped cross section with an open end facing upward. The spring portion S112 is disposed between the projection PP2 and the extended portion 89B of the plate member 889 while being compressed in the belt moving direction.

The spring portion S113 biases the plate member Z1 toward the projection PP2. The spring portion S113 has a U-shaped cross section with an open end facing upward. The spring portion S113 is disposed between the upstream wall 186B and the extended portion ZB of the plate member Z1 while being compressed in the belt moving direction.

The base portion S111 connects the spring portions S112 and S113 to each other. The base portion S111 has a portion extending rearward from the spring portion S113, another portion extending rightward from the rear end of the portion, and still another portion extending frontward from the right end of the other portion and connecting to the spring portion S112.

In the tenth modification, the two nip forming members 885 and X1 are biased toward the downstream wall 86C and the projection PP2, respectively, so that the pads 88 and Y may contact or abut against the respective downstream wall 86C and the projection PP2. This configuration may also achieve effects similar to those of the illustrative embodiment. In the tenth modification, the nip forming members 885 and X1 are both biased toward the rear or a downstream side in the belt moving direction. This configuration may prevent or reduce the nip forming members 885 and X1 from being moved by friction with the endless belt 83 against the biasing force of the flat spring S11.

Figure 22A:
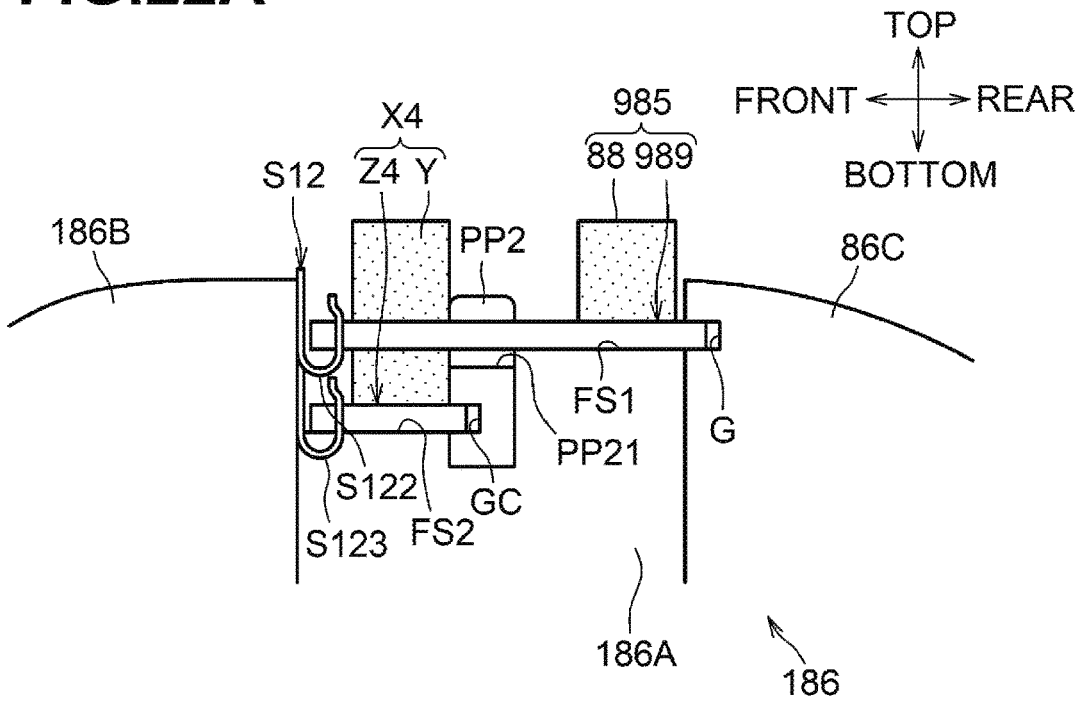
FIG. 22A is a cross-sectional view of a pressure unit of a fuser according to an eleventh modification.
Figure 22B:
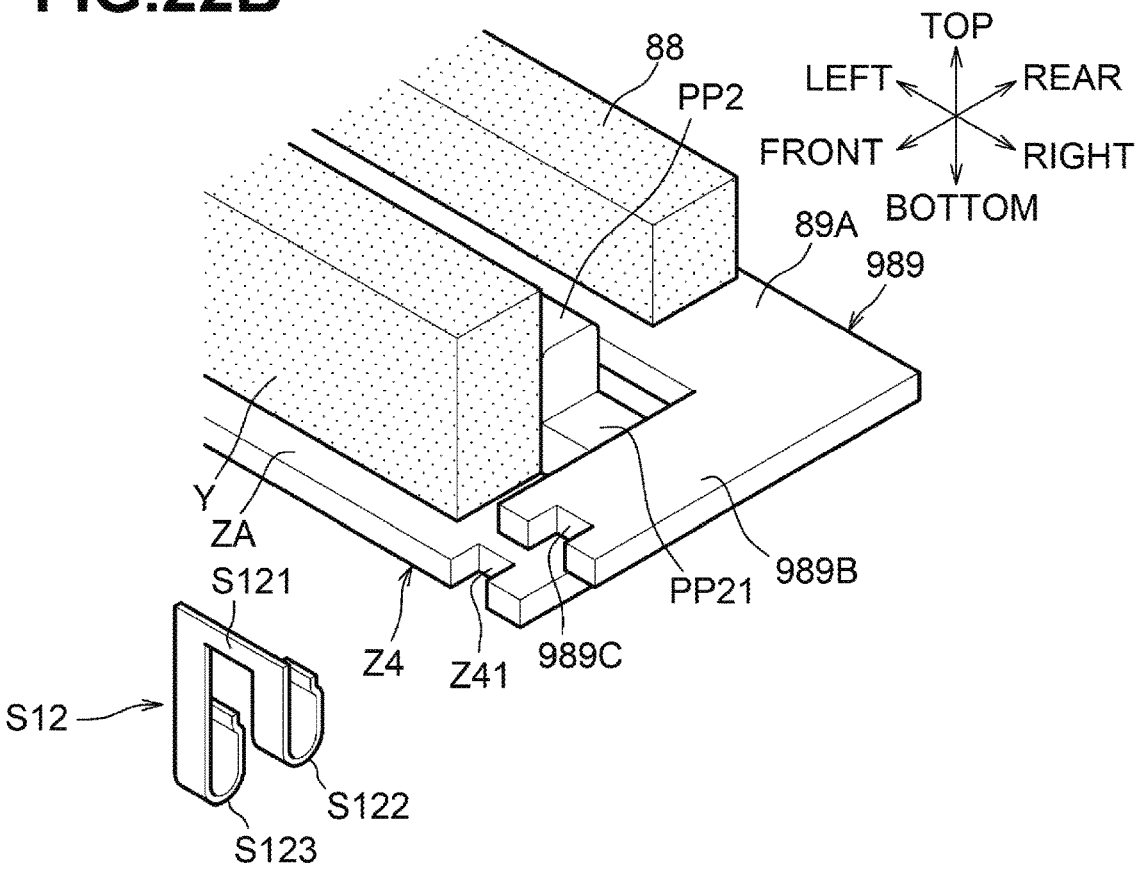
FIG. 22B is a perspective view of a portion of the pressure unit of the fuser according to the eleventh modification, illustrating a flat spring and its surrounding components.

An eleventh modification will now be described referring to FIGS. 22A and 22B. In the eleventh modification, two nip forming members 985 and X4 may be biased by a flat spring S12 toward the rear or a downstream side in the belt moving direction.

Figure 21A:
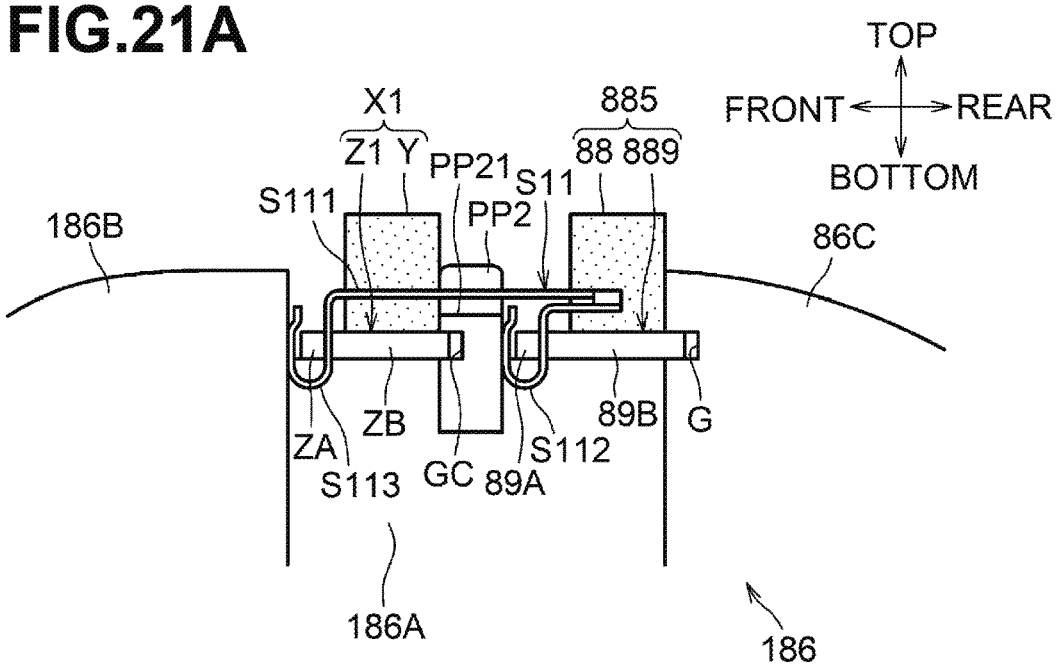
FIG. 21A is a cross-sectional view of a pressure unit of a fuser according to a tenth modification.
Figure 21B:
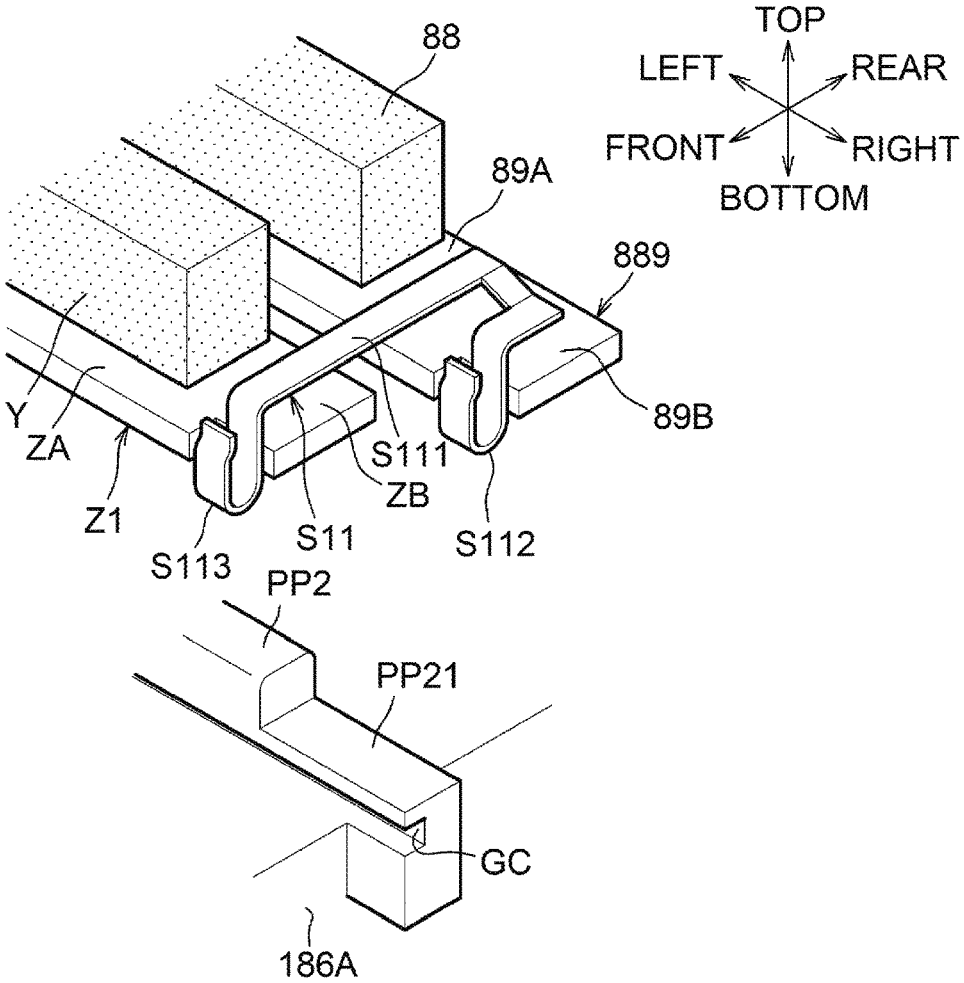
FIG. 21B is a perspective view of a portion of the pressure unit of the fuser according to the tenth modification, illustrating a flat spring and its surrounding components.

The nip forming member 985 includes a pad 88, which is similar to that of the tenth modification as depicted in FIGS. 21A and 21B, and a plate member 989, which is slightly different from the plate member 889 of the tenth modification. The plate member 989 includes a base portion 89A, which is similar to that of the tenth modification, and an extended portion 989B that extends frontward from a right end of the base portion 89. The extended portion 989B has a recess 989C at a front end thereof.

The nip forming member X4 includes a pad Y, which is similar to that of the tenth modification, and a plate member Z4, which is slightly different from the plate member Z1 of the tenth modification. The plate member Z4 includes a base portion ZA, which is similar to that of the tenth modification. The base portion ZA has a recess Z41 at a front right end portion thereof. The recess Z41 of the plate member Z4 is located between the recess 989C of the plate member 989 and the pad Y in the right-left direction.

The plate member Z4 is located below the plate member 989. In one example, a holder 186 of the eleventh modification includes a support surface FS1 that supports the plate member 989 such that the plate member 989 is movable in the belt moving direction, and a support surface FS2 that supports the plate member Z4 such that the plate member Z4 is movable in the belt moving direction. The support surface FS1 is located above the support surface FS2.

The flat spring S12 includes a base portion S121, a spring portion S122, and another spring portion S123.

The spring portion S122 biases the plate member 989 toward the downstream wall 86C. The spring portion S122 has a U-shaped cross section with an open end facing upward. The spring portion S122 is disposed between the upstream wall 186B and the extended portion 989B (e.g., the recess 989C) of the plate member 989 while being compressed in the belt moving direction.

The spring portion S123 biases the plate member Z4 toward a projection PP2, which is similar to that of the tenth modification. The projection PP2 has a stepped portion PP21, so that the extended portion 989B of the plate member 989 may not interfere with the stepped portion PP21. The spring portion S123 has a U-shaped cross section with an open end facing upward. The spring portion S123 is disposed between the upstream wall 186B and the plate member Z4 (e.g., the recess Z41) while being compressed in the belt moving direction.

The base portion S121 connects the spring portions S122 and S123 to each other. The base portion S121 is connected to upper ends of the spring portions S122 and S123.

The eleventh modification may also enable the two nip forming members 985 and X4 to be biased toward the downstream wall 86C and the projection PP2, respectively.

In the illustrative embodiment, each of the two biasing members biases a respective one of the right and left end portions of the plate member. In another embodiment, for example, one, biasing member may bias a central portion of the plate member in its longitudinal direction (e.g., the right-left direction). The biasing member and the second biasing member may be separate members.

In the illustrative embodiment, the pad 88 is pressed against the inner peripheral surface 83A of the endless belt 83. In another embodiment, for example, a slide sheet may be disposed between the inner peripheral surface of the endless belt and the pad for smooth rotation of the endless belt.

In the illustrative embodiment, the restricting member is integral with the holder 86. In another embodiment, a restricting member may not be integral with the holder but may be a member separate from the holder.

In the illustrative embodiment, the restricting member, e.g., the downstream wall 86C, is disposed downstream of the nip forming member 85 in the belt moving direction. In another embodiment, a restricting member may be disposed upstream of a nip forming member in the belt moving direction.

In the illustrative embodiment, the plate member 89 is a relatively thin plate. In another embodiment, a plate member may be a relatively thick member having a thickness greater than the plate member 89.

In the illustrative embodiment, configuration, according to one or aspects of the disclosure, that serves to form a nip portion NP is applied to the fuser 8. In another embodiment, configuration according to one or aspects of the disclosure may be applied to a sheet conveying device other than the fuser. For example, in a sheet conveying device including a conveying roller and a conveying belt configured to convey a sheet by holding the sheet between the conveying roller and the conveying belt, configuration according to one or more aspects of the disclosure may be applied to the conveying belt.

In the illustrative embodiment, the pad 88 has a rectangular parallelepiped shape. In another embodiment, a pad may have a shape different from the rectangular parallelepiped shape.

In the illustrative embodiment, the halogen lamp is used as the heater 82. In another embodiment, a carbon heater may be used as the heater 82.

In the illustrative embodiment, the heat roller 81 having the heater 82 therein is illustrated as a rotatable member. Examples of the rotatable member may include an endless heating belt whose inner peripheral surface may be heated by a heater.

A fuser may include an external heater that heats an outer peripheral surface of a rotatable member, or an induction heating ("IH") element. A rotatable member contacting an endless belt may be indirectly heated by a heater disposed within an interior space of the endless belt. A heater may be disposed within an interior space of each of the rotatable member and the endless belt.

Configuration, according to one or more aspects of the disclosure, that serves to form a nip portion NP may be applied to various types of fusers. For example, in a fuser including a fuser roller, a pressure roller that forms a nip portion NP between the fuser roller and the pressure roller, and a heater unit that contacts the fuser roller at a predetermined pressure and heats the fuser roller, the fuser being configured to fuse a toner image onto a sheet at the nip portion NP, configuration according to one or aspects of the disclosure may be applied to the heater unit. For example, if the heater unit includes an endless belt and a heating member that nips the endless belt in cooperation with the fuser roller between the heating member and the fuser roller, the heating member may be biased by a biasing member.

In the illustrative embodiment, aspects of the disclosure are applied to the laser printer 1. In another embodiment, aspects of the disclosure may be applied to other types of image forming apparatuses, such as copiers and multifunctional devices.

Each of the elements or components which have been described in the illustrative embodiment and modifications may be used in any combination.

What is claimed is:

1. A fuser comprising:

a rotatable member having a rotational axis;

a belt comprising an outer peripheral surface facing the rotatable member;

a heater configured to heat the rotatable member;

a first pad configured to create a nip portion between the belt and the rotatable member;

a first restricting member surrounded by the belt, the first restricting member comprising a surface facing the first pad in a moving direction at the nip portion of the belt;

a first biasing member arranged to bias the first pad in the moving direction to make contact between the first pad and the surface of the first restricting member, a second pad disposed upstream of the first pad in the moving direction;

a second restricting member surrounded by the belt, the second restricting member comprising a surface facing the second pad in the moving direction; and a second biasing member arranged to bias the second pad in the moving direction to make contact between the second pad and the surface of the second restricting member.

2. The fuser according to claim 1, further comprising:

a first plate adhered to the first pad, wherein the first biasing member biases the first plate to make contact between the first pad and the surface of the first restricting member without making contact between the first plate and the surface of the first restricting member in the moving direction.

3. The fuser according to claim 2, wherein the first restricting member comprises a first hollow positioned downstream of the surface of the first restricting member in the moving direction, and wherein the first plate includes a protrusion positioned downstream in the moving direction of a downstream edge of an adhered portion at which the first pad is adhered to the first plate, the protrusion being inserted into the first hollow.

4. The fuser according to claim 2, further comprising:

a third biasing member, wherein a first side of the first plate is biased by the first biasing member, wherein a second side of the first plate is biased by the third biasing member, and wherein the first side of the first plate is spaced from the second side of the first plate in a width direction parallel to the rotational axis.

5. The fuser according to claim 2, further comprising:

a second plate adhered to the second pad, wherein the second biasing member biases the second plate to make contact between the second pad and the surface of the second restricting member without making contact between the second plate and the surface of the second restricting member in the moving direction.

6. The fuser according to claim 5, wherein the second restricting member comprises a second hollow positioned upstream of the surface of the second restricting member in the moving direction, and wherein the second plate includes a protrusion positioned upstream in the moving direction of an upstream edge of an adhered portion at which the second pad is adhered to the second plate, the protrusion being inserted into the second hollow.

7. The fuser according to claim 5, further comprising:

a fourth biasing member, wherein a first side of the second plate is biased by the second biasing member, wherein a second side of the second plate is biased by the fourth biasing member, and wherein the first side of the second plate is spaced from the second side of the second plate in a width direction parallel to the rotational axis.

8. The fuser according to claim 1, wherein the first biasing member is arranged to bias the first pad downstream in the moving direction, and wherein the second biasing member is arranged to bias the second pad upstream in the moving direction.

9. The fuser according to claim 1, wherein the surface of the first restricting member is disposed downstream of the first pad in the moving direction, and wherein the surface of the second restricting member is disposed upstream of the second pad in the moving direction.

10. The fuser according to claim 1, wherein the first biasing member is a part of a spring, and wherein the second biasing member is another part of the spring.

11. The fuser according to claim 10, further comprising:

a holder surrounded by the belt and holding the first pad and the second pad, wherein the spring comprises a contact portion contacting a part of the holder.

12. The fuser according to claim 11, wherein the part of the holder is spaced from at least one of the first pad and the second pad in a width direction parallel to the rotational axis.

13. The fuser according to claim 10, wherein the spring comprises a tension spring.

14. The fuser according to claim 10, wherein the spring comprises a plate spring.

15. The fuser according to claim 10, wherein the spring comprises a compression spring.

16. The fuser according to claim 1, wherein the rotatable member comprises a roller, and wherein the heater is disposed in an interior space of the roller.

17. A fuser comprising:

a rotatable member having a rotational axis;

a belt comprising an outer peripheral surface facing the rotatable member;

a heater configured to heat the rotatable member;

a pad configured to create a nip portion between the belt and the rotatable member;

a plate adhered to the pad, a restricting member surrounded by the belt, the restricting member comprising a surface facing the pad in a moving direction at the nip portion of the belt; and a biasing member arranged to bias the plate in the moving direction to make contact between the pad and the surface of the restricting member without making contact between the plate and the surface of the restricting member in the moving direction.

18. The fuser according to claim 17, wherein the biasing member is spaced from the pad in a width direction parallel to the rotational axis.

* * * * *